US007219601B2

(12) United States Patent
Tanaka

(10) Patent No.: US 7,219,601 B2
(45) Date of Patent: May 22, 2007

(54) EMPTY CONTAINER PRESSING APPARATUS

(75) Inventor: Shoji Tanaka, Hiratsuka (JP)

(73) Assignees: Cosmopower, Inc. (JP); Sumiko Tsurumaki (JP)

( * ) Notice: Subject to any disclaimer, the term of this patent is extended or adjusted under 35 U.S.C. 154(b) by 0 days.

(21) Appl. No.: 11/293,677

(22) Filed: Dec. 2, 2005

(65) Prior Publication Data

US 2006/0117968 A1 Jun. 8, 2006

(30) Foreign Application Priority Data

Dec. 3, 2004 (JP) ..... 2004-352083

(51) Int. Cl.
*B30B 1/32* (2006.01)

(52) U.S. Cl. ..... 100/193; 100/209; 100/237; 100/240; 100/269.01; 100/317; 100/324; 100/902

(58) Field of Classification Search ..... 100/193, 100/208, 209, 221, 229 A, 229 R, 232, 237, 100/240, 245, 269.01, 269.14, 275, 324, 100/325, 326, 902, 317; 241/149, 270; 72/404, 72/453.18

See application file for complete search history.

(56) References Cited

U.S. PATENT DOCUMENTS

| | | | | |
|---|---|---|---|---|
| 3,695,175 | A * | 10/1972 | Bausenbach et al. | 100/193 |
| 3,734,006 | A * | 5/1973 | Hennelis | 100/349 |
| 6,035,776 | A * | 3/2000 | Segura | 100/97 |

FOREIGN PATENT DOCUMENTS

| | | |
|---|---|---|
| JP | 50-55772 | 5/1975 |
| JP | 57-014498 | 1/1982 |
| JP | 05-177394 | 7/1993 |
| JP | 05-177397 | 7/1993 |
| JP | 2001-179496 | 7/2001 |
| JP | 2001-225196 | 8/2001 |
| WO | PCT/SE96/00647 | 5/1996 |
| WO | PCT/JP2005/020542 | 11/2005 |

OTHER PUBLICATIONS

Translation copy of JP 49-033482.*
58-147699(Japanese).

* cited by examiner

*Primary Examiner*—Lowell A. Larson
*Assistant Examiner*—Jimmy Nguyen
(74) *Attorney, Agent, or Firm*—Anderson Kill & Olick, PC

(57) ABSTRACT

An empty container pressing apparatus is disclosed. The empty container pressing apparatus includes at least one pressure applying cylinder section in which a first cylinder chamber and a second cylinder chamber separated by a pressure receiving piston which slides in a cylinder chamber having the first cylinder chamber and the second cylinder chamber are disposed. In addition, an inlet to which a pressure applying medium supplied from the outside is input and an outlet which drains the input pressure applying medium is connected to the first cylinder chamber. Further, the empty container pressing apparatus includes at least one pressing section which is connected to the pressure applying cylinder section and provides a pressing piston that moves together with the pressure receiving piston via a pressure transmitting member and applies pressing force to a empty container, and the empty container is pressed.

7 Claims, 15 Drawing Sheets

EMPTY CONTAINER PRESSING APPARATUS

BACKGROUND OF THE INVENTION

1. Field of the Invention

The present invention generally relates to an empty container pressing apparatus which densely compresses used empty containers, such as cans, bottles, and PET (polyethylene terephthalate) bottles so that the empty containers can be easily utilized as recycled resources.

2. Description of the Related Art

In countries where concerns regarding the preservation of the natural environment and recycling the used goods are high, various technologies that densely compress empty containers, such as used empty cans, used empty bottles, and used empty PET bottles, and waste such as vegetable garbage have been developed. As the technologies to densely compress the empty containers, the following have been disclosed.

For example, in Patent Document 1, as shown in FIG. 13, an empty container press 100 is disclosed as an easily handled machine. The empty container press 100 includes a base stand 101 where an empty container (not shown) can be vertically disposed, a guide post 103 disposed outside a container disposing section 102 of the base stand 101, a container press 104 which is vertically movably attached to the guide post 103 and presses the empty container disposed on the base stand 101 by pressing from above with a foot, and a container body buckling mechanism 105 which deforms and buckles the container body by pressing from the outside before stamping the empty container with the container press 104.

Patent Document 1 describes that even a steel can, being difficult to be deformed, can be easily stamped and containers such as an aluminum can and a plastic bottle can be easily stamped with lower stamping power than that of a conventional apparatus.

In Patent Document 2, as shown in FIG. 14, an empty can pressing apparatus 200 is disclosed. The empty can pressing apparatus 200 provides a separation carrying means 201 that separates input empty cans from input empty bottles based on mass and sends the separated cans and bottles to an empty can route 202 and an empty bottle route 203 respectively, configured in the apparatus 200. Further, a pressing section 204 is provided in the middle of the empty can route 202 to press an empty can ECc to be a plane shape, and an output section 205 for outputting the pressed can is provided in the empty can route 202 and an output section 206 for outputting the empty bottle is provided in the empty bottle route 203. In the pressing section 204, a motor is used as the power generating device.

According to this invention, an empty bottle (not shown) is separated from the empty can ECc and only the empty can ECc can be pressed into a plane shape.

In Patent Document 3, as shown in FIG. 15, an empty can automatic pressing apparatus which provides a first process executing apparatus (not shown) and a second process executing apparatus (not shown) is disclosed. The first process executing apparatus includes an empty can supplying conveyer, a first vibration feeder, an empty bottle separating device, a glass carrying conveyer, and so on which are all disposed on a frame. The second process executing apparatus includes an aluminum can carrying conveyer, a steel can carrying conveyer, a supplementary hopper, and two presses 310 which are all disposed on the same frame. The presses 310 repeatedly press empty cans (not shown) input to a pressing chamber 311, which are pressed by the first and the second process executing apparatuses beforehand with a low load by a slider 312. After this, a predetermined amount of the empty cans is hardened by being pressed with a high force. With this, aluminum pellets and iron pellets are formed.

According to this invention, by only inputting empty containers in which empty cans, bottles, and trash are mixed into a hopper, the trash and glass fragments are separated. Further, aluminum pellets into which aluminum empty cans are pressed and hardened and iron pellets into which steel empty cans are pressed and hardened are automatically formed. Therefore, a large amount of empty cans can be easily pressed at high speed under good sanitary conditions.

[Patent Document 1] Japanese Patent No. 3494609 (Paragraphs 0016 through 0018 and 0021, and FIGS. 1 through 4)

[Patent Document 2] Japanese Laid-Open Patent Application No. 2001-179496 (Claim 1, Paragraphs 0016 through 0018 and 0021, and FIGS. 2, 3, 5, and 7)

[Patent Document 3] Japanese Laid-Open Patent Application No. 5-177397 (Paragraphs 0009, 0032 through 0043, and FIGS. 2, 3, 8, and 9)

However, in the empty container press described in Patent document 1, in a case where each empty can is pressed by using a person's stamping power, when a small amount of empty cans are pressed, this empty container press can be used. However, when a relatively large amount of empty cans are pressed, pressing efficiency is low and a large amount of labor is required.

In addition, in the empty can pressing apparatus described in Patent document 2, empty cans can be pressed without using a person's labor; however, it is required to provide a device such as a motor that generates power to press the empty cans. Further, the pressing process is executed by determining whether a container is an empty can; since one empty can is pressed by one operation, the pressing efficiency is low.

In addition, in the empty can automatic pressing apparatus described in Patent document 3, even when trash is mixed with empty cans and empty bottles, these are suitably separated and the empty cans can be pressed at high speed under good sanitary conditions. However, devices such as motors which generate power must be disposed in various positions in the apparatus. Therefore, the apparatus becomes large and also its manufacturing cost becomes high.

In other words, in the conventional technologies, there is a problem in that the pressing efficiency becomes low when empty cans are pressed by a pressing apparatus which does not include a power generating device, further, there is a problem in that a power generating device must be provided to make the pressing efficiency high and the apparatus becomes large and its manufacturing cost becomes high.

SUMMARY OF THE INVENTION

The present invention may provide an empty container pressing apparatus of a relatively small size which can densely compress empty containers, such as empty cans, empty bottles, and empty PET bottles efficiently at low cost, without a large power generating source by utilizing liquid pressure such as tap water pressure as a power source, the apparatus being novel and useful so as to substantially obviate one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by an empty container pressing apparatus particularly pointed out in the specification in such full, clear, concise, and exact terms as to enable a person having ordinary skill in the art to practice the invention.

According to one aspect of the present invention, there is provided an empty container pressing apparatus. The empty container pressing apparatus includes at least one pressure applying cylinder section in which a first cylinder chamber and a second cylinder chamber separated by a pressure receiving piston which slides in a cylinder chamber having the first cylinder chamber and the second cylinder chamber are disposed, wherein a changing over valve that works as an inlet to which a pressure applying medium supplying from the outside is input and also works as an outlet which drains the input pressure applying medium is connected to the first cylinder chamber; at least one pressing section which is connected to the pressure applying cylinder section, and provides a pressing piston that moves together with the pressure receiving piston via a pressure transmitting member and applies pressing force to a plurality of empty containers; and a piston returning member that returns the pressure receiving piston to a position the pressure receiving piston occupied before being moved; wherein at least two of the empty container pressing apparatuses are disposed by being connected with each other, wherein pressure received at the pressure receiving piston of one of the empty container pressing apparatuses is transmitted to the pressure receiving piston or the pressure transmitting member of the other of the empty container pressing apparatuses via a transferring section composed of a transferring member including one of a liquid and a mechanical linking member, and the pressure receiving piston and the pressing piston of one of the empty container pressing apparatuses and the pressure receiving piston and the pressing piston of the other of the empty container pressing apparatuses are moved together.

According to the present invention, pressing empty containers (that is, as empty cans, empty bottles, and empty PET bottles) signifies, for example, in a case of the empty cans, that the empty cans are densely compressed by a pressing piston. In a case of the empty bottles, the empty bottles are crushed by the pressing piston. In a case of the empty PET bottles, the empty PET bottles are compressed by the pressing piston. In addition, the pressing piston is a member that presses the empty containers. The first pressing piston and the second pressing piston work together as the pressing piston.

In addition, the pressure transmitting member in the empty container pressing apparatus of the present invention causes the pressure receiving piston and the pressing piston to work together by transmitting the pressure received at the pressure receiving piston. The transferring section is composed of a transferring member including liquid or a mechanical linking member, which transfers pressure received at the pressure receiving piston of one of the empty container pressing apparatuses to the pressure receiving piston or the pressure transmitting member of the other of the empty container pressing apparatuses.

With this structure, when a pressure applying medium having suitable pressure is input only to the first cylinder chamber of the pressure receiving cylinder section, the pressure receiving piston can be pushed. Since the pressing piston can be moved together when the pressure receiving piston is pushed, the pressing force can be applied to the empty containers. In the empty container pressing apparatus of the present invention, the empty containers can be pressed without providing a power generating apparatus. Further, since many empty containers can be pressed by one operation, its efficiency is high.

Especially, in a case where plural empty container pressing apparatuses are connected, when the pressure receiving piston of one of the pressure applying cylinder sections is pushed by receiving the pressure, the pressure can be transmitted to the pressure receiving piston of the other of the pressure applying cylinder sections or the pressure transmitting member connecting to the pressure receiving piston via the transferring section composed of the transferring member including liquid or the mechanical linking member, which connects to both the empty container pressing apparatuses. Therefore, the pressing piston in the pressing section of the other of the empty container pressing apparatuses can be moved together with the one of the apparatuses. On the other hand, in this structure, when pressure is applied to the pressing piston of the other empty container pressing apparatus, the pressing piston of one of the empty container pressing apparatuses can be move together with the other of the apparatuses.

According to another aspect of the present invention, there is provided an empty container pressing apparatus. The empty container pressing apparatus includes a pressure applying cylinder section in which a first cylinder chamber and a second cylinder chamber separated by a first pressure receiving piston which slides in a cylinder chamber having the first cylinder chamber and the second cylinder chamber are disposed, wherein a changing over valve that works as an inlet to which a pressure applying medium supplied from the outside is input and also works as an outlet which drains the input pressure applying medium is connected to the first cylinder chamber; a first pressing section which is connected to the pressure applying cylinder section, and provides a first pressing piston which moves together with the first pressure receiving piston via a first pressure transmitting member and applies pressing force to a plurality of empty containers; a sub cylinder section which is connected to the pressure receiving cylinder section and provides a first cylinder chamber, a second cylinder chamber, and a second pressure receiving piston or a second pressure transmitting member which works together with the first pressure receiving piston via a transferring section composed of a transferring member including one of a liquid and a mechanical linking member; a second pressing section which is connected to the sub cylinder section and provides a second pressing piston which moves together with the first pressing piston by pressure transmitted from the second pressure receiving piston or the second pressure transmitting member; and a piston returning member that returns the first pressure receiving piston to a position the first pressure receiving piston occupied before being moved.

In this structure, the first pressing piston of the first pressing section and the second pressing piston of the second pressing section can be suitably moved together, by only providing one pressure applying cylinder section having the first cylinder chamber to which the pressure applying medium is supplied from the outside. Therefore, the empty containers can be efficiently pressed by a small amount of the pressure applying medium.

According to another aspect of the present invention, the transferring section connects the second cylinder chambers of one of the pressure applying cylinder sections and the other of the pressure applying cylinder sections and one of water and oil is supplied to fill in the second cylinder chambers and the transferring section. The transferring section connects the second cylinder chambers of the pressure applying cylinder section and the sub cylinder section and one of water and oil is supplied to fill in the second cylinder chambers and the transferring section. The transferring section is a bar member that is fixed between the first pressure transmitting member of the pressure applying cylinder section and the second pressure transmitting member of the sub cylinder section, or a retractable bar member that is hung between the first pressure transmitting member of the pressure applying cylinder section and the second pressure transmitting member of the sub cylinder section in a manner so that the retractable bar member can swing by setting the center to its axle.

In the empty container pressing apparatus in which two or more empty container pressing apparatuses are connected, when one of water and oil is supplied to fill in the second cylinder chambers and the transferring section, the pressure applied by the pressure receiving piston of one of the pressure applying cylinder sections can be efficiently transmitted to the pressure receiving piston of the sub cylinder section. Therefore, the pressure receiving piston of the sub cylinder section can be efficiently moved together with the piston of the one of the pressure applying cylinder sections.

In a case where the transferring section is a bar member that is fixed between the first pressure transmitting member of the pressure applying cylinder section and the second pressure transmitting member of the sub cylinder section, or a retractable bar member that is hung between the first pressure transmitting member of the pressure applying cylinder section and the second pressure transmitting member of the sub cylinder section in a manner so that the retractable bar member can swing by setting the center to its axle, the pressure applied by the pressure receiving piston of the pressure applying cylinder section can be efficiently transmitted to the pressure receiving piston of the sub cylinder section. Therefore, the pressure receiving piston of the sub cylinder section can be efficiently moved together with the piston of the pressure applying cylinder section.

In addition, the piston returning member is connected to a changing over valve that works as an inlet to which the pressure applying medium supplied from the outside is input and also works as an outlet which drains the input pressure applying medium.

In a case where the empty container pressing apparatus of the present invention has the above structure, the pressure receiving piston can be returned to a position it occupied before being moved after the pressure receiving piston is pushed by inputting the pressure applying medium in the first cylinder chamber. Therefore, the pressing piston connected to the pressure receiving piston can be returned to a position it occupied before being moved.

In addition, the empty container to be pressed in the empty container pressing apparatus is at least one of an empty can, an empty bottle, and an empty PET bottle. Further, it is preferable that the pressure applying medium be water and the pressure of the pressure applying medium be 0.2 to 1 MPa.

In addition, the empty container pressing apparatus of the present invention further includes a collecting section connecting to the pressing section that collects a pressed empty container. Further, a bottom plate of at least one of the pressing sections is movably connected to the collecting section.

In a case where the empty container pressing apparatus of the present invention has the above structure, the empty container pressed by the pressing section can be collected in the collecting section. Further, when the bottom plate of the pressing section is movably connected to the collecting section, the pressed empty container can be collected in the collecting section by only moving the bottom plate of the pressing section.

In addition, the empty container pressing apparatus further includes a heating member that heats at least one of the pressing sections. With this structure, the empty container can be pressed by applying heat. Especially, when an empty PET bottle is heated and pressed, since the pressed empty PET bottle cannot resume to its original shape, the empty PET bottle can be suitably pressed.

According to the present invention, an empty container pressing apparatus of a relatively small size, which can densely compress empty containers such as empty cans, empty bottles, and empty PET bottles, efficiently at a low cost, without a large power generating source by utilizing liquid pressure such as tap water pressure as a pressure source, can be provided.

Other objects and further features of the present invention will become apparent from the following detailed description when read in conjunction with the accompanying drawings.

DESCRIPTION OF THE PREFERRED EMBODIMENTS

In the following, embodiments of the present invention are described with reference to the accompanying drawings.

[First Embodiment]

Figure 1:
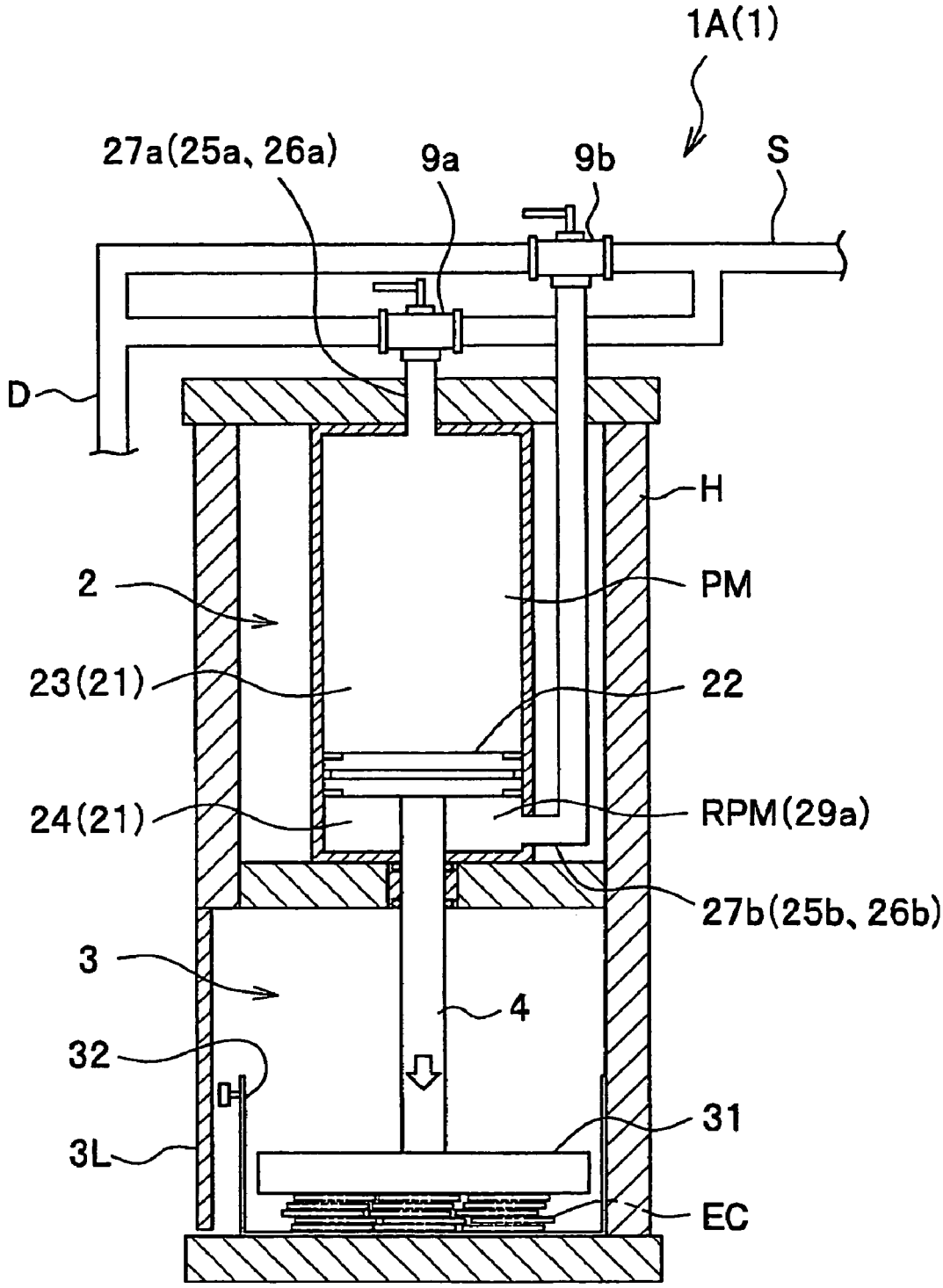
FIG. 1 is a cross-sectional view explaining a structure of an empty container pressing apparatus according to a first embodiment of the present invention.
Figure 2:
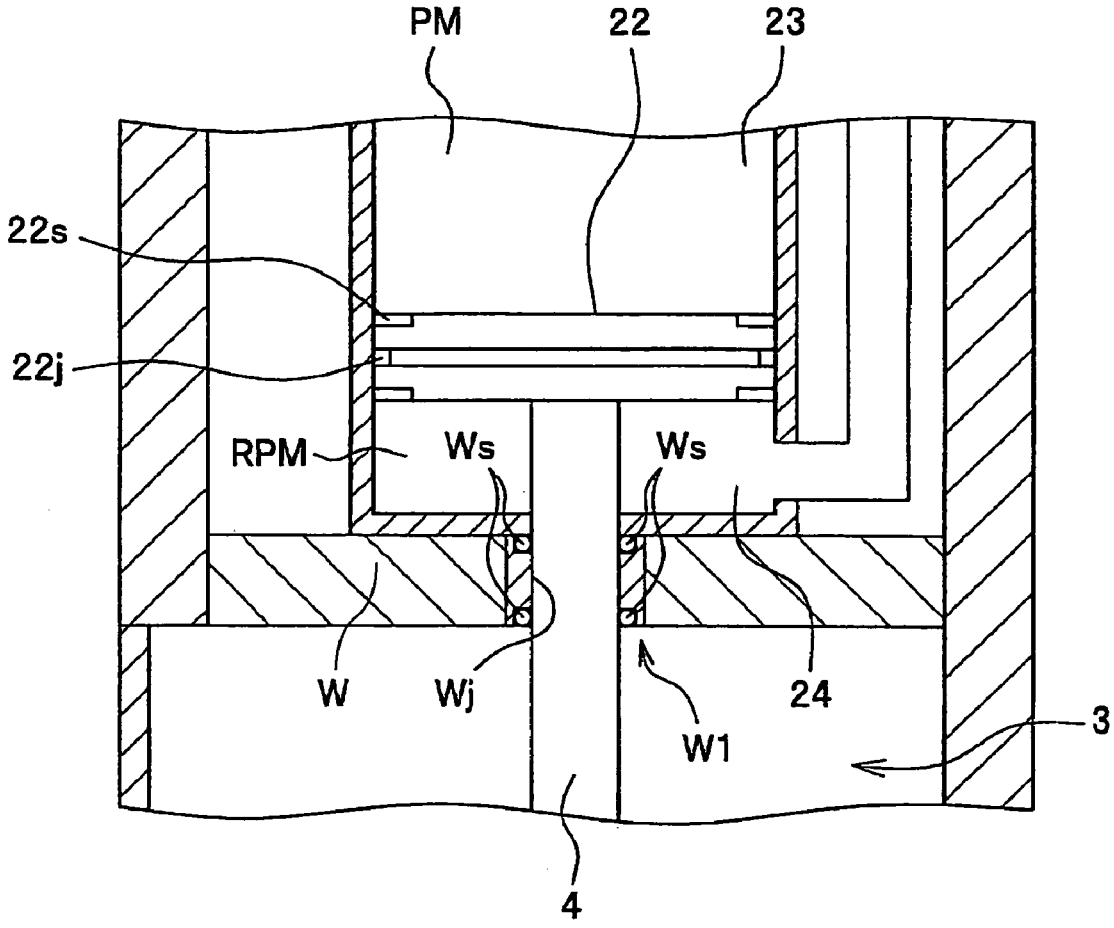
FIG. 2 is an enlarged cross-sectional view explaining a pressure applying cylinder section and a pressing section of the empty container pressing apparatus shown in FIG. 1.

FIG. 1 is a cross-sectional view explaining a structure of an empty container pressing apparatus 1A according to a first embodiment of the present invention. FIG. 2 is an enlarged cross-sectional view explaining a pressure applying cylinder section and a pressing section of the empty container pressing apparatus 1A shown in FIG. 1.

The empty container pressing apparatus 1A according to the first embodiment of the present invention has a structure in which the smallest number of elements are provided in empty container pressing apparatuses of the present invention and which provides a pressure applying cylinder section 2 and a pressing section 3 connecting to the pressure applying cylinder section 2 in a housing H.

[Pressure Applying Cylinder Section 2]

First, the pressure applying cylinder section 2 is explained.

The pressure applying cylinder section 2 provides a pressure receiving piston 22 which slides inside a cylinder chamber 21, and has a first cylinder chamber 23 and a second cylinder chamber 24 which are separated by the pressure receiving piston 22 in the cylinder chamber 21. As shown in FIG. 1, in the upper end of the pressure applying cylinder section 2, a pipe 27*a*, which works as an inlet 25*a* to which a pressure applying medium PM supplied from the outside to the pressure applying cylinder section 2 is input and also works as an outlet 26*a* which outputs the input pressure applying medium PM, is connected to a three way valve 9*a*. The three way valve 9*a* is connected to a water pipe S by its first way, to the pipe 27*a* connecting to the first cylinder chamber 23 by its second way, and to a drain pipe D by its third way.

In addition, the empty container pressing apparatus 1A according to the first embodiment provides a piston returning mechanism 29*a* which includes the second cylinder chamber 24 to return the pushed pressure receiving piston 22 to a position it occupied before being pushed. In the piston returning mechanism 29*a*, the lower side end of the second cylinder chamber 24 is connected to a pipe 27*b*, which works as an inlet 25*b* to which a pressure applying medium (hereinafter, this pressure applying medium is referred to as a return pressure applying medium RPM for convenience of explanation) supplied from the outside to the second cylinder chamber 24 to return the pressure receiving piston 22 is input, also works as an outlet 26*b* which outputs the input return pressure applying medium RPM from the second cylinder chamber 24, and is connected to a three way valve 9*b*. The three way valve 9*b* is connected to the water pipe S by its first way, to the pipe 27*b* connecting to the second cylinder chamber 24 of the pressure applying cylinder section 2 by its second way, and to the drain pipe D by its third way.

In order to push the pressure receiving piston 22 in this structure, the following operations are executed. That is, the water pipe S is connected to the first cylinder chamber 23 of the pressure applying cylinder section 2 by operating the three way valve 9*a*, and also the drain pipe D is connected to the second cylinder chamber 24 of the pressure applying cylinder section 2 by operating the three way valve 9*b*. By the above operations, the pressure applying medium PM is input to the first cylinder chamber 23, the pressure receiving piston 22 is pushed by the pressure of the pressure applying medium PM, and the return pressure applying medium RPM in the second cylinder chamber 24 is output, that is, the pressure receiving piston 22 can be pushed downward. Therefore, a pressing piston 31 connected to the pressure receiving piston 22 via a pressure transmitting rod 4 can be pushed.

In order to return the pushed pressure receiving piston 22 to a position it occupied before being pushed, the following operations are executed. That is, the drain pipe D is connected to the first cylinder chamber 23 of the pressure applying cylinder section 2 by operating the three way valve 9*a*, and also the water pipe S is connected to the second cylinder chamber 24 of the pressure applying cylinder section 2 by operating the three way valve 9*b*. By the above operations, the return pressure applying medium RPM is input to the second cylinder chamber 24, the pressure receiving piston 22 is pushed upward by the pressure of the return pressure applying medium RPM, and the pressure applying medium PM in the first cylinder chamber 23 is output. Therefore, the pushed pressure receiving piston 22 can be returned to the position it occupied before being pushed (the piston returning mechanism 29*a*).

In this, in order to execute the above operations with convenience and sureness, it is preferable that the three way valves 9*a* and 9*b* be changed over at the same time by one changing over operation with a manual operation or by using an arbitrary control device.

As the pressure applying medium PM and the return pressure applying medium RPM supplied from the outside, air compressed by an air compressor can be used; however, water, in particular, tap water obtained from a public water pipe is preferable; further, the tap water can be easily obtained at private houses and other facilities. In a case where water is used, even when pressure is applied to the water, since the volume of the water is difficult to be changed, the pressure receiving piston 22 can be suitably pushed. Especially, when public tap water is used as the pressure applying medium PM and the return pressure applying medium RPM, since public tap water is supplied at regulated suitable pressure, the pressure receiving piston 22 can be suitably pushed without providing a specific apparatus to generate power in the empty container pressing apparatus 1A. Therefore, there is no need to provide an apparatus to generate power in the empty container pressing apparatus 1A when using the tap water. Consequently, its initial and operating cost can be reduced compared with a case additionally using a power source such as an internal combustion engine. Further, air pollution does not occur, because there is no internal combustion engine in, that is, the empty container pressing apparatus of the present invention is an environment-friendly apparatus.

In addition, when public tap water is used as the pressure applying medium PM and the return pressure applying medium RPM, water drained from the first cylinder chamber 23 and the second cylinder chamber 24 can be reused in a bathroom, for example, to avoid wasting the water. When the empty container pressing apparatus 1A is used in a factory, drained water can be reused by supplying it to a boiler.

When the pressure of the tap water is used as the pressure of the pressure applying medium PM and the return pressure applying medium RPM, the pressure of the tap water supplying a wide region from a town area to a mountainous area can be used. It is preferable that the pressure be 0.2 MPa (2 kgf/cm$^2$) to 0.4 MPa (4 kgf/cm$^2$) or more and 1 MPa (10 kgf/cm$^2$) to 0.7 MPa (7 kgf/cm$^2$) or less. When the pressure is within the above pressure range, empty containers EC can be suitably pressed.

A value in which the pressure of the pressure applying medium PM is multiplied by the area of the pressure receiving piston 22 produces a pushing force of the pressing piston 31. Therefore, when the pressure of the pressure applying medium PM is low, for example, under 0.2 MPa, a large force can be obtained by enlarging the area of the pressure receiving piston 22. To enlarge the area of the pressure receiving piston 22, it is enough to enlarge the diameter of the pressure receiving piston 22. For example, when the diameter ϕ of the pressure receiving piston 22 is 150 mm and the pressure of the pressure applying medium PM is 0.4 MPa (4 kgf/cm$^2$), the pushing force becomes approximately 7 kN (700 kgf).

The pressure, by which the pressing piston 31 can press the empty containers EC by receiving the pushing force of the pressure receiving piston 22, depends on the area of the pressing face of the pressing piston 31. For example, when the diameter ϕ of the pressing face of the pressing piston 31 is 300 mm and the pushing force of the pressure receiving piston 22 is 7 kN, the pressure pressing the empty containers EC becomes 0.1 MPa (1 kgf/cm$^2$) approximately.

In addition, when the moving distance (stroke) of the pressure receiving piston 22 and the pressing piston 31 is made longer, the pressing amount of the empty containers EC per one press can be increased.

The diameters and the moving distance of the pressure receiving piston 22 and the pressing piston 31 can be suitably decided. For example, the diameter ϕ of the pressure receiving piston 22 can be decided to be 50 mm, 100 mm, 200 mm, 250 mm or more, the moving distance thereof can be decided to be 200 mm, 300 mm, 400 mm, 500 mm, 600 mm or more, and the diameter ϕ of the pressing piston 31 can be decided to be 200 mm, 250 mm, 300 mm, 350 mm, 400 mm, 450 mm, 500 mm or more.

The cross section of the pressure applying cylinder section 2 is preferred to be a circle by considering that the pressure receiving piston 22 slides inside thereof. However, the cross section is not limited to the circle; for example, a square cross section, a hexagonal cross section, and an octagonal cross section can be used.

The shape of the pressure receiving piston 22 is preferred to be the same shape as the cross section to the axle direction of the pressure applying cylinder section 2 along which the pressure receiving piston 22 slides; however, the size of the pressure receiving piston 22 is slightly smaller than that of the inside of the pressure applying cylinder section 2 so that the pressure receiving piston 22 can slide along the inside of the pressure applying cylinder section 2. In addition, as shown in FIG. 2, in order to prevent the pressure applying medium PM and the return pressure applying medium RPM from being leaked and to prevent a pressure loss caused by the leakage, it is preferable that a sealing material 22*s* made of a silicon material or a resin be disposed at the upper rim of the pressure receiving piston 22. Further, in order to increase the sliding ability of the pressure receiving piston 22, it is preferable that a bearing member 22*j* such as oil-less metal and slide bearings be disposed on the circumferential face of the pressure receiving piston 22.

[Pressing Section 3]

Next, the pressing section 3 is explained in detail. As shown in FIG. 1, the empty container pressing apparatus 1A according to the first embodiment of the present invention provides the pressing section 3 to press the empty containers EC under the pressure applying cylinder section 2.

In the pressing section 3, the pressing piston 31, for pressing the empty containers EC, connected to the pressure receiving piston 22 via the pressure transmitting rod 4 is disposed. As shown in FIG. 2, the pressure transmitting rod 4 is connected to the pressure receiving piston 22 and the pressing piston 31 via a sliding section W1 formed in a wall W between the pressure applying section 2 and the pressing section 3 in a manner so that the pressure transmitting rod 4 can slide in the sliding section W1. As the pressure transmitting rod 4, a metal rod is preferable in order to directly transmit the pressure of the pressure applying medium PM to the pressing piston 31. However, the pressure transmitting rod 4 is not limited to this, and other members can be used.

As shown in FIG. 2, in order to prevent the return pressure applying medium RPM from being leaked to the pressing section 3 and to prevent a pressure loss caused by the leakage, it is preferable that sealing materials Ws such as an O ring made of a silicon material or a resin be disposed at the connecting section between the sliding section W1 and the pressing section 3. Further, in order to increase the sliding ability of the pressure transmitting rod 4, it is preferable that a bearing member Wj such as oil-less metal and slide bearings be disposed in the sliding section W1.

As shown in FIG. 1, the empty container pressing apparatus 1A according to the first embodiment provides a stock box 32 that can be inserted into and extracted from the pressing section 3. That is, first, an arbitrary number of the empty containers EC are put in the stock box 32, the stock box 32 is inserted in the pressing section 3 by opening a lid 3L disposed in a wall of the pressing section 3, and the empty containers EC are pressed. After the empty containers EC are pressed, the stock box 32 is extracted from the lid 3L. However, the structure of the empty container pressing apparatus according to the embodiments is not limited to the above structure, and another structure can be formed as follows.

Figure 3:
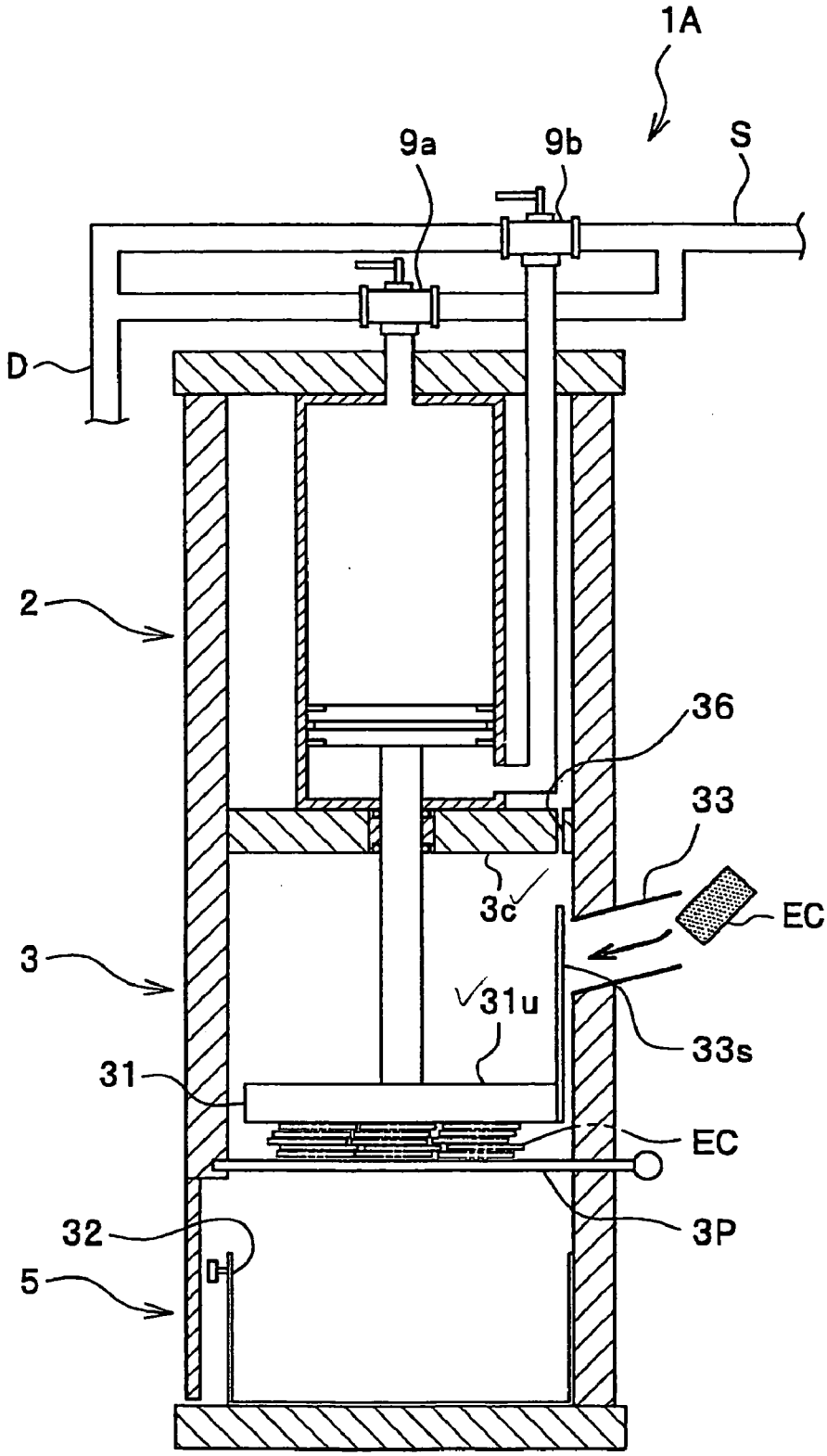
FIG. 3 is a cross-sectional view explaining a structure of an empty container pressing apparatus having a collecting section according to the first embodiment of the present invention.

That is, as shown in FIG. 3, a collecting section 5 is disposed under the pressing section 3, further, a bottom plate 3P of the pressing section 3 positioned above the collecting section 5 is configured to be opened/closed by sliding, and the stock box 32 is disposed in the collecting section 5. According to this structure, the empty containers EC pressed by the pressing section 3 can be collected in the collecting section 5 by only sliding the bottom plate 3P. In this case, the empty containers EC can be easily input to the pressing section 3, by disposing an input section 33 through which the empty containers EC are input in the pressing section 3.

In a case where the input section 33 through which the empty containers EC are input is disposed in the pressing section 3, when the empty containers EC are input while the pressing piston 31 is sliding up and down, there is a risk that the pressing piston 31 cannot be returned to a position before being pushed caused by an empty container EC staying in a space between the upper face 31*u* of the pressing piston 31 and the ceiling face 3*c* of the pressing section 3. To prevent such a problem, in order that the empty container EC is not input in the space between the upper face 31*u* of the pressing piston 31 and the ceiling face 3*c* of the pressing section 3, it is preferable that a shutter 33*s* shuttering the input section 33 and a shutter path 36 which the shutter 33*s* be inserted into and extracted from be disposed.

Figure 4:
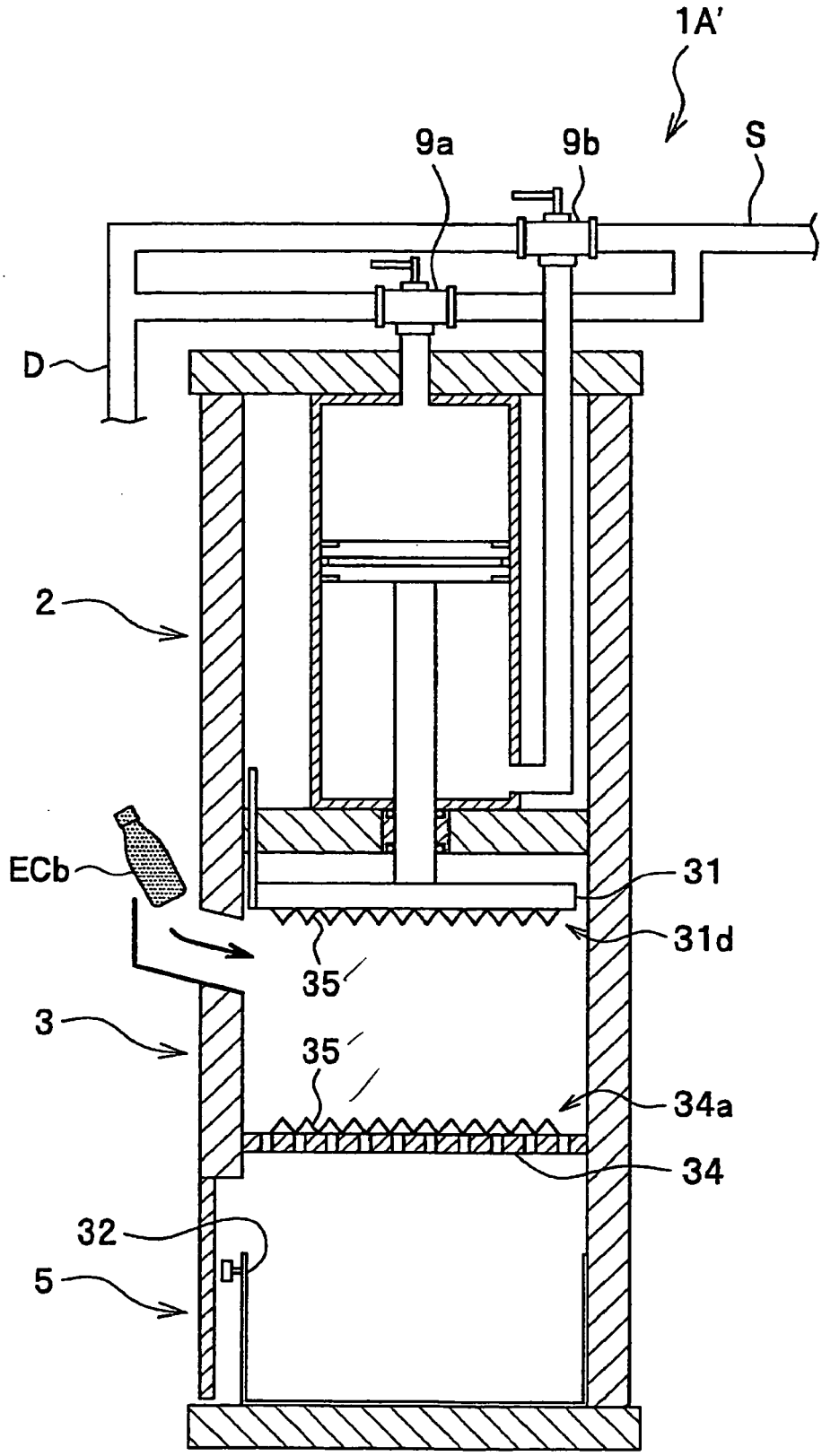
FIG. 4 is a cross-sectional view explaining a structure of an empty container pressing apparatus for pressing empty bottles that is a modified example of the first embodiment of the present invention.

Next, a case in which empty bottles are pressed (crushed) is explained. As shown in FIG. 4, in a case where empty bottles ECb are crushed by using an empty container pressing apparatus 1A', after crushing the empty bottles ECb, fragments of the empty bottles ECb are dropped into the collecting section 5. In order to easily collect the fragments, an empty bottle putting plate 34 on which the empty bottles ECb are put has a structure having holes, for example, in which a lattice whose one side is approximately 2 to 5 cm is formed or through holes having an arbitrary shape are formed. This is preferable. Further, in order to easily crush the empty bottles ECb by applying pressure, it is preferable that plural crests 35 be formed on at least one of the upper face 34*a* of the empty bottle putting plate 34 and the pressing face 31*d* of the pressing piston 31. Moreover, it is more preferable to form the plural crests 35 on both the upper face 34*a* and the pressing face 31*d*. In a case where the plural crests 35 are formed on both the upper face 34*a* and the pressing face 31*d*, when the crests 35 on the upper face 34*a* match corresponding crests 35 on the pressing face 31*d*, the empty bottles ECb can be more easily crushed. However, the crests 35 on both faces can be formed not to mesh with each other.

As mentioned above, the empty container pressing apparatus 1A (1A') according to the first embodiment of the present invention includes the pressure applying cylinder section 2, the pressure receiving piston 22 disposed in the pressure applying cylinder section 2, the pressing section 3 connected to the pressure applying cylinder section 2, and the pressing piston 31 disposed in the pressing section 3. The empty container pressing apparatus 1A (1A') can efficiently press the empty containers EC, such as empty cans, empty bottles, and empty PET bottles by using the pressure of liquid such as tap water as the power source, without using a large power source generating apparatus. Therefore, according to the first embodiment of the present invention, an empty container pressing apparatus whose size is relatively small and manufacturing cost is low can be provided, because the empty container pressing apparatus does not include an additional power source generating apparatus.

In addition, since the empty container pressing apparatus according to the present invention can press objects with suitable force, the apparatus can be applied to a pickle making apparatus that pickles vegetables by using a container (preferably, a pressure-tight container), such as a metal container, a glass container, a plastic container, a pottery container, and a wooden container, as the stock box. According to the apparatus, the pickles can be easily made without putting/removing a heavy stone on/from the lid of the container.

[Second Embodiment]

Figure 5:
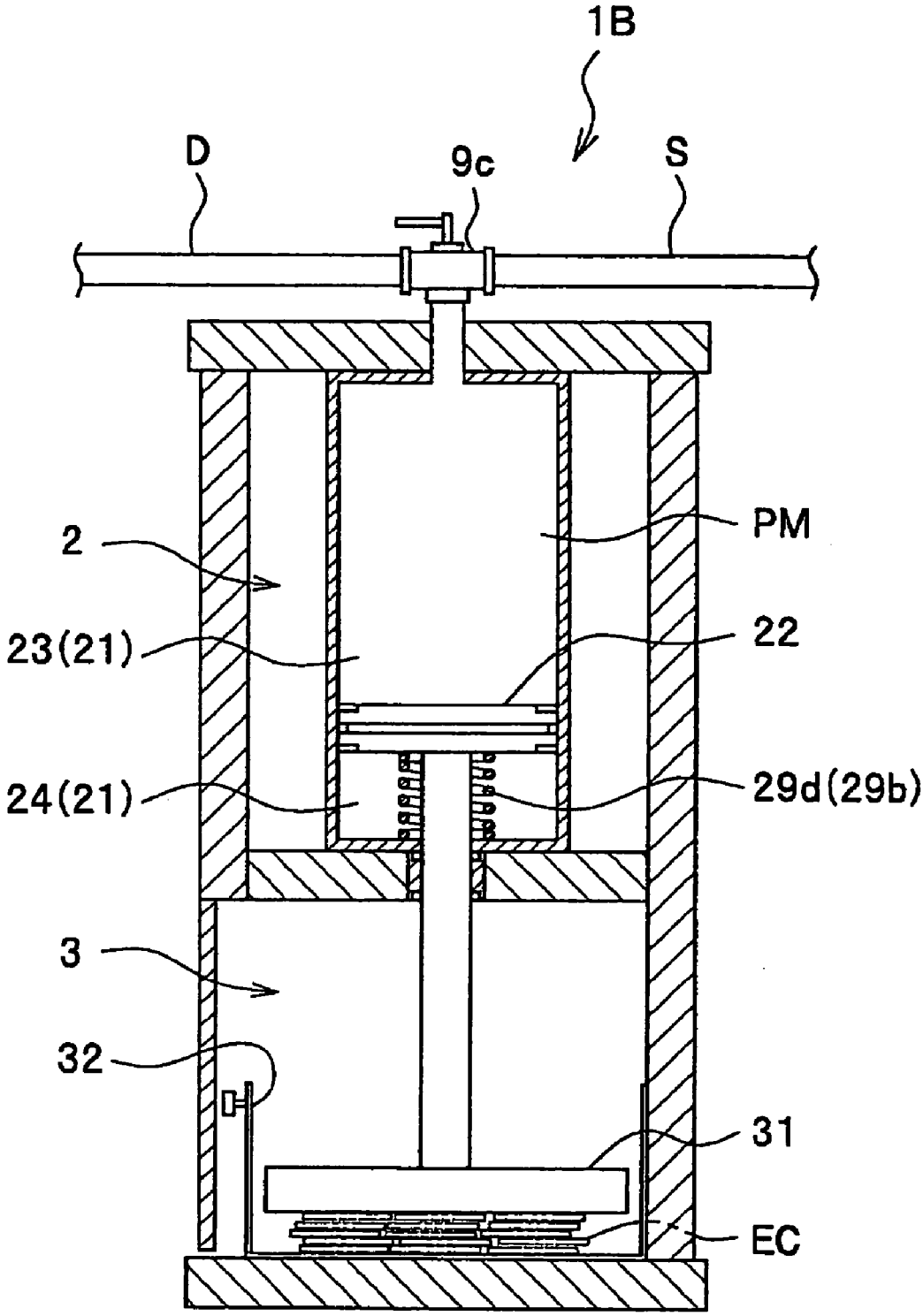
FIG. 5 is a cross-sectional view explaining a structure of an empty container pressing apparatus according to a second embodiment of the present invention.

Next, referring to FIG. 5, a second embodiment of the present invention is explained. An empty container pressing apparatus 1B according to the second embodiment is formed by changing a part of the empty container pressing apparatus 1A according to the first embodiment. Therefore, the detailed explanation of the same elements explained in the first embodiment is omitted.

As shown in FIG. 5, the empty container pressing apparatus 1B has a structure similar to that of the empty container pressing apparatus 1A according to the first embodiment. That is, the empty container pressing apparatus 1B includes the pressure applying cylinder section 2 in which the first cylinder chamber 23 and the second cylinder chamber 24 are provided by being separated by the pressure receiving piston 22 which slides in the cylinder chamber 21, and the pressing section 3 that presses the empty containers EC by using the pressing piston 31 that is connected to the pressure applying cylinder section 2. However, a piston returning mechanism 29*b* that returns the pressure receiving piston 22 to a position it occupied before being pushed is different from the piston returning mechanism 29*a* in the first embodiment.

That is, in the empty container pressing apparatus 1B, an elastic member 29*d* such as a coil spring is disposed in the second cylinder chamber 24 separated by the pressure receiving piston 22 in the pressure applying cylinder section 2, and the piston returning mechanism 29*b* is formed by the elastic member 29*d*, and the pressure receiving piston 22 is pushed upward by the force of the elastic member 29*d*. In the above structure, the pressure applying medium PM is input to the first cylinder chamber 23 by operating a three way valve 9*c*, and the pressure receiving piston 22 is pushed by the pressure of the pressure applying medium PM. Further, when the first cylinder chamber 23 is connected to the drain pipe D by operating the three way valve 9*c*, the pressure receiving piston 22 is pushed upward and is returned to the position it occupied before being pushed while the pressure applying medium PM in the first cylinder chamber 23 is being output by the force of the elastic member 29*d*.

[Third Embodiment]

Figure 6:
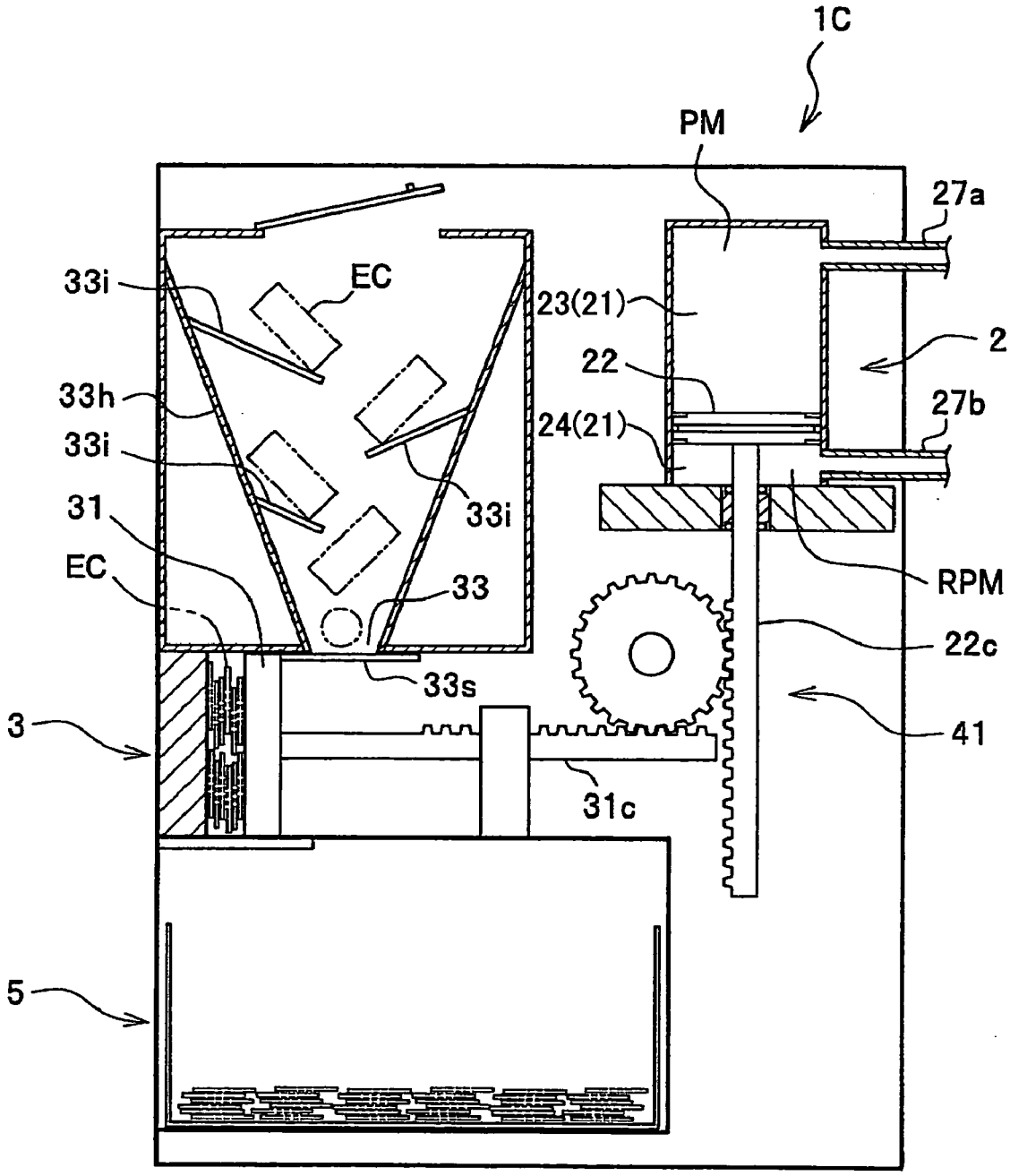
FIG. 6 is a cross-sectional view explaining a structure of an empty container pressing apparatus according to a third embodiment of the present invention.

Next, referring to FIG. 6, a third embodiment of the present invention is explained. An empty container pressing apparatus 1C according to the third embodiment is formed by changing a part of the empty container pressing apparatus 1A according to the first embodiment. Therefore, the detailed explanation of the same elements explained in the first embodiment is omitted.

As shown in FIG. 6, the empty container pressing apparatus 1C has a structure similar to that of the empty container pressing apparatus 1A according to the first embodiment. That is, the empty container pressing apparatus 1C includes the pressure applying cylinder section 2 in which the first cylinder chamber 23 and the second cylinder chamber 24 are provided by being separated by the pressure receiving piston 22 which slides in the cylinder chamber 21, the pressing section 3 that presses the empty containers EC by using the pressing piston 31 disposed in the direction perpendicular to the pressure receiving piston 22 by being connected to the pressure applying cylinder section 2, and the collecting section 5 that collects the pressed empty containers EC disposed under the pressing section 3.

In this structure, the pressure receiving piston 22 can be pushed by inputting the pressure applying medium PM in the first cylinder chamber 23 via the pipe 27*a* from the outside and by outputting the return pressure applying medium RPM from the second cylinder chamber 24 via the pipe 27*b*.

Further, the pressure receiving piston 22 can be pushed upward by inputting the return pressure applying medium RPM to the second cylinder chamber 24 via the pipe 27*b* and by outputting the pressure applying medium PM from the first cylinder chamber 23 via the pipe 27*a*. In addition, as shown in FIG. 6, a hopper 33*h* having an approximately inverse triangle shape connecting to the input section 33 is disposed on the pressing section 3 so that the empty containers EC can be easily input to the pressing section 3.

In the empty container pressing apparatus 1C, a rack and pinion structure is used as a pressure transmitting mechanism 41 that transmits the force of the pressure applying cylinder section 2 to the pressing section 3. Therefore, as shown in FIG. 6, the pressure receiving piston 22 transmits the pressure of the pressure applying medium PM by sliding vertically, and the pressing piston 31 is moved horizontally by the rack and pinion structure.

When the pressure transmitting mechanism 41 is formed by the rack and pinion structure, a double power structure can be formed by combining two or more pinions whose diameters are different. For example, a rack formed in a rod 22*c* of the pressure receiving piston 22 is meshed with a pinion whose diameter is large (not shown) and a rack formed in a rod 31*c* of the pressing piston 31 is meshed with a pinion whose diameter is small (not shown). With this, even when the pressure of the pressure applying medium PM being received by the pressure receiving piston 22 is low or the diameter of the pressure applying cylinder section 2 is small, a large force can be applied to the pressing piston 31.

In addition, when the pressure applying medium PM has large pressure, a rack and pinion structure, in which the diameter of the pinion at the side of the pressure receiving piston 22 is small and the diameter of the pinion at the side of the pressing piston 31 is large, can be used. With this structure, the empty containers EC can be pressed by a small amount of the pressure applying medium PM.

In the pressure receiving piston 22 of the pressure applying cylinder section 2 in the empty container pressing apparatus 1C, the pressure receiving piston 22 is slid in the vertical direction and the pressing piston 31 is slid in the horizontal direction by the rack and pinion structure. That is, one sliding direction is perpendicular to the other sliding direction. However, the sliding directions can be changed by changing the attaching angle of the pressure transmitting mechanism 41 having the rack and pinion structure. That is, the sliding directions can be the same or the sliding angle between them can be set to be an arbitrary angle such as 30° and 60°.

In the empty container pressing apparatus 1C in which the pressing piston 31 moves in the horizontal direction, in order to prevent the empty containers EC from being supplied from the hopper 33*h* while the empty containers EC are pressed by the pressure receiving piston 22 and the pressing piston 31 being moved together, the shutter 33*s* is preferably disposed. Further, as shown in FIG. 6, it is preferable to dispose the collecting section 5 for collecting the pressed empty containers EC under the pressing section 3. In the hopper 33*h*, as shown in FIG. 6, guide plates 33*i* are slantingly disposed at alternate positions so that each of the empty containers EC is put sideways during its dropping to the bottom of the hopper 33*h*.

[Fourth Embodiment]

Figure 7:
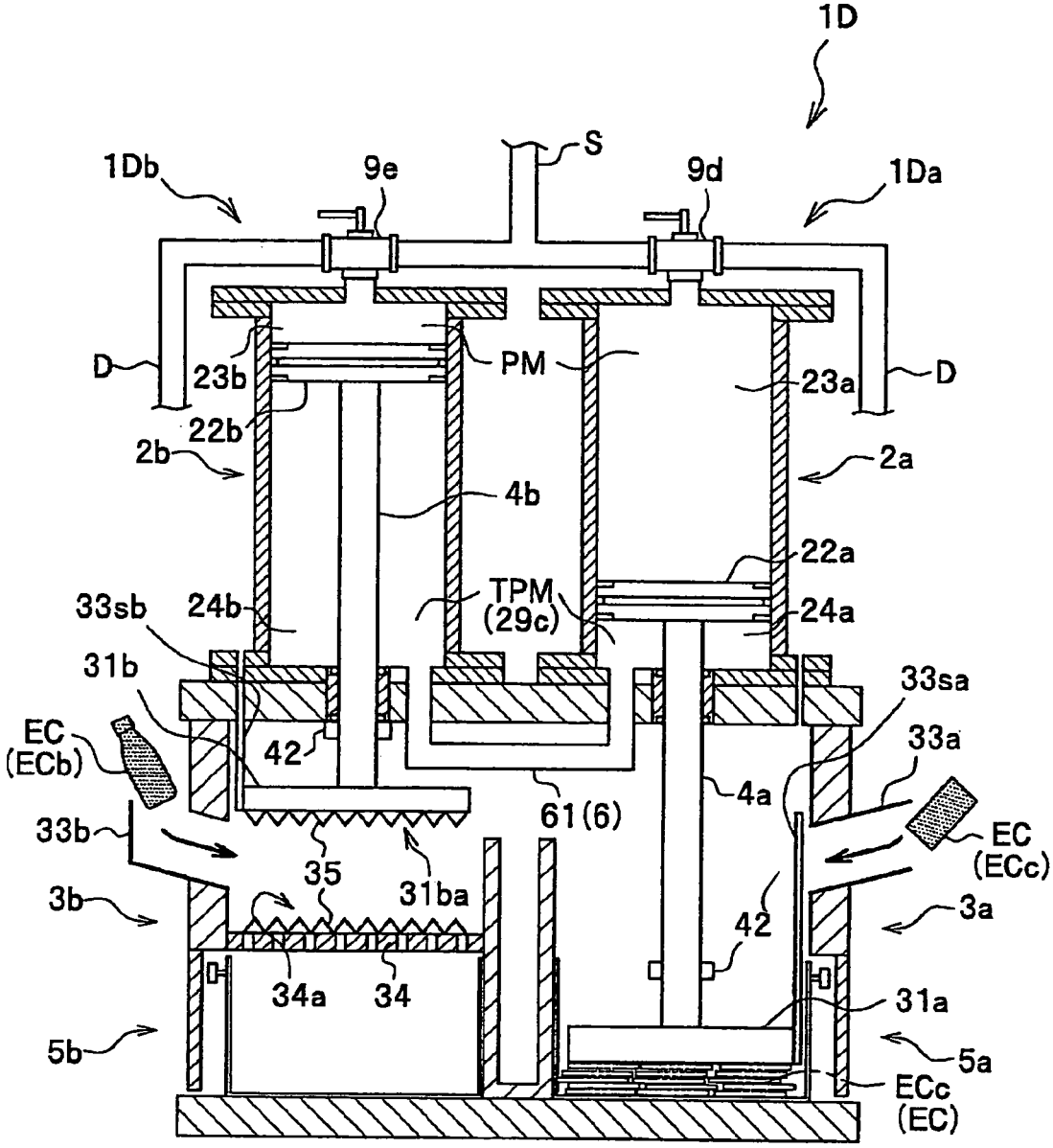
FIG. 7 is a cross-sectional view explaining a structure of an empty container pressing apparatus according to a fourth embodiment of the present invention.

Next, referring to FIG. 7, a fourth embodiment of the present invention is explained. In the fourth embodiment, two or more empty container pressing apparatuses having a structure similar to the structures explained above are connected. In FIG. 7, two empty container pressing apparatuses are connected. First, an empty container pressing apparatus 1D according to the fourth embodiment is explained. In this, the detailed explanation of the same elements explained in the empty container pressing apparatus 1A according to the first embodiment is omitted.

As shown in FIG. 7, the empty container pressing apparatus 1D has a structure in which an empty container pressing apparatus 1Da and an empty container pressing apparatus 1Db each having a structure similar to that of the empty container pressing apparatus 1A according to the first embodiment are connected. In order to transfer pressure received at a first pressure receiving piston 22*a* of one empty container pressing apparatus 1Da to a second pressure receiving piston 22*b* of the other empty container pressing apparatus 1Db, a transferring means 6 (a transferring section 61) which transfers this pressure is provided. The transferring means 6 can also transfer pressure received at the second pressure receiving piston 22*b* of the empty container pressing apparatus 1Db to the first pressure receiving piston 22*a* of the empty container pressing apparatus 1Da. The transferring means 6 has a U tube type structure which connects second cylinder chambers 24*a* and 24*b* by the transferring section 61. Further, water is supplied to fill in the second cylinder chambers 24*a* and 24*b* and the transferring section 61. This water is referred to as transferring water TPM for convenience of explanation.

In FIG. 7, generally, the suffix "a" is added to the structural elements in the empty container pressing apparatus 1Da and the suffix "b" is added to the structural elements in the empty container pressing apparatus 1Db.

With this structure, for example, when the first pressure receiving piston 22*a* is pushed by connecting the water pipe S to a first cylinder chamber 23*a* of the empty container pressing apparatus 1Da with the operation of a three way valve 9*d* and by applying pressure of the pressure applying medium PM to the first pressure receiving piston 22*a* of the empty container pressing apparatus 1Da, the transferring water TPM in the second cylinder chamber 24*a* of the empty container pressing apparatus 1Da can be transferred to the second cylinder chamber 24*b* of the empty container pressing apparatus 1Db via the transferring section 61. At this time, when the first cylinder chamber 23*b* of the empty container pressing apparatus 1Db is connected to the drain pipe D by operating a three way valve 9*e* and the pressure applying medium PM in the first cylinder chamber 23*b* of the empty container pressing apparatus 1Db is output, the second pressure receiving piston 22*b* of the empty container pressing apparatus 1Db can be pushed upward (piston returning mechanism 29*c*). Therefore, the first pressure receiving piston 22*a* can be pushed and the first pressing piston 31*a* which is connected to the first pressure receiving piston 22*a* via a pressure transmitting rod 4*a* can be moved together; therefore, the empty containers EC (empty cans ECc) can be pressed by the first pressing piston 31*a*.

On the other hand, when the second pressure receiving piston 22*b* is pushed by connecting the water pipe S to the first cylinder chamber 23*b* of the empty container pressing apparatus 1Db with the operation of the three way valve 9*e* and by applying pressure of the pressure applying medium PM to the second pressure receiving piston 22*b* of the empty container pressing apparatus 1Db, the transferring water TPM in the second cylinder chamber 24*b* of the empty container pressing apparatus 1Db can be transferred to the second cylinder chamber 24*a* of the empty container pressing apparatus 1Da via the transferring section 61. At this time, when the first cylinder chamber 23*a* of the empty container pressing apparatus 1Da is connected to the drain pipe D by operating the three way valve 9*d* and the pressure applying medium PM in the first cylinder chamber 23*a* of the empty container pressing apparatus 1Da is output, the first pressure receiving piston 22*a* of the empty container pressing apparatus 1Da can be pushed upward (piston returning mechanism 29*c*). Therefore, the second pressure receiving piston 22*b* can be pushed and the second pressing piston 31*b* which is connected to the second pressure receiving piston 22*b* via a pressure transmitting rod 4*b* can be moved together; therefore, the empty containers EC (empty bottles ECb) can be pressed (crushed) by the second pressing piston 31*b*.

As mentioned above, in the empty container pressing apparatus 1D according to the fourth embodiment, by operating the three way valves 9*d* and 9*e*, the first pressure receiving piston 22*a* (the second pressure receiving piston 22*b*) is pushed and the empty containers ECc (the empty bottles ECb) are pressed (crushed) by together moving the first pressing piston 31*a* (the second pressing piston 31*b*), and at the same time, the second pressure receiving piston 22*b* (the first pressure receiving piston 22*a*) is returned to a position it occupied before being pushed.

In this, similar to the three way valves 9*a* and 9*b* in the first embodiment, it is preferable that the three way valves 9*d* and 9*e* be changed over at the same time by one changing over operation with a manual operation or by using an arbitrary control device.

Further, in the above structure, the second cylinder chambers 24*a* and 24*b* and the transferring section 61 are filled with the transferring water TPM. However, the structure is not limited to this, for example, transmission oil such as mineral oil and synthetic oil can be used instead of water. In a case where water or oil is used, when pressure is applied to the water or the oil by the first pressure receiving piston 22*a* (the second pressure receiving piston 22*b*), the volume of the water or the oil is hardly changed. Therefore, the second pressure receiving piston 22*b* (the first pressure receiving piston 22*a*) can be pushed by the pressure being directly transferred.

In addition, in the empty container pressing apparatus 1D, a collecting section 5*a* (a collecting section 5*b*) is disposed under the first pressing section 3*a* (the second pressing section 3*b*).

Further, as shown in FIG. 7, since the transferring section 61 is disposed in the first pressing section 3*a* and the second pressing section 3*b*, in order that the first pressing piston 31*a* and the second pressing piston 31*b* do not collide with the transferring section 61 when being moved upward, a stopper 42 for preventing the collision is attached to the first pressure transmitting rod 4*a* (the second pressure transmitting rod 4*b*). This structure is preferable.

[Fifth Embodiment]

Figure 8:
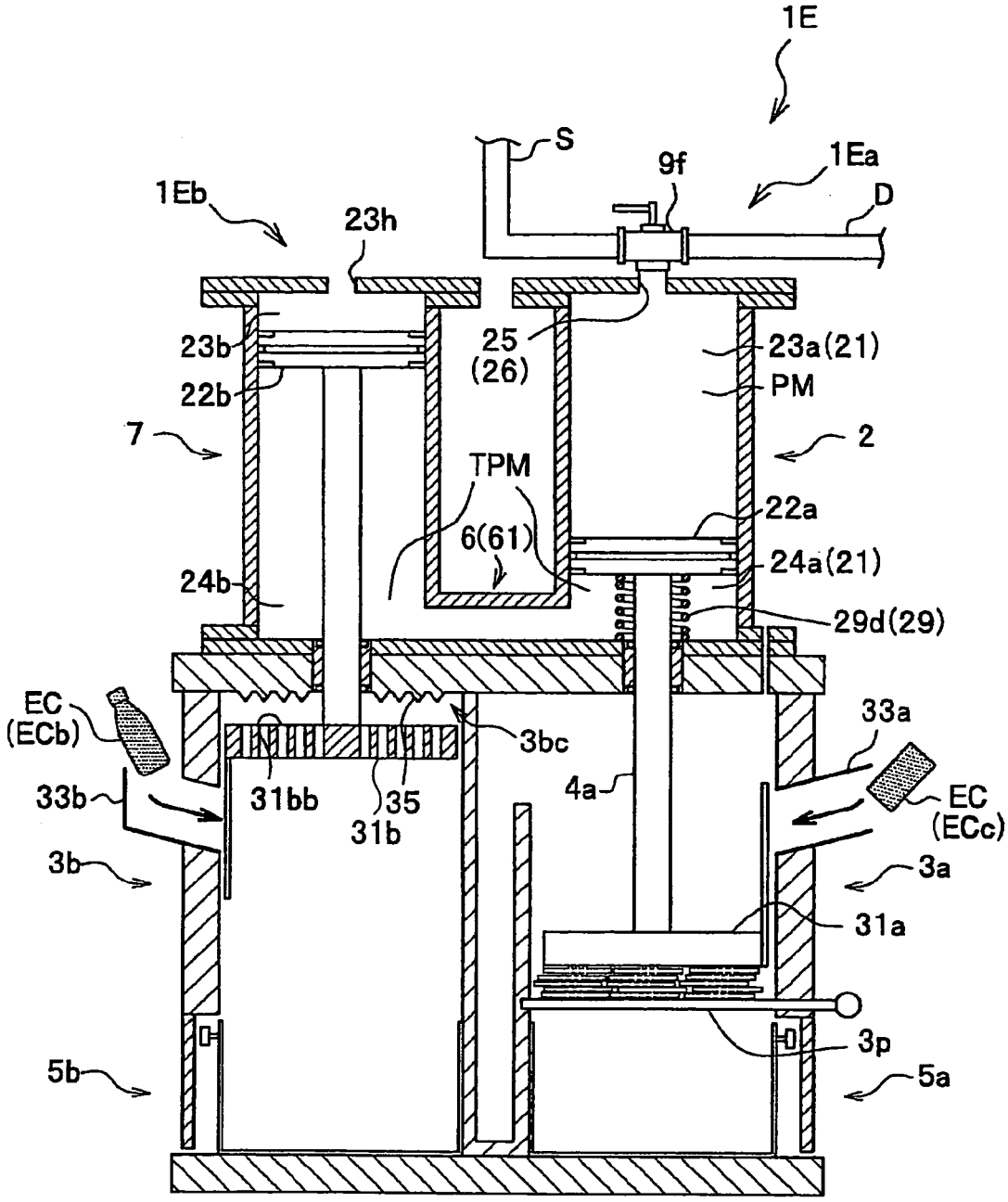
FIG. 8 is a cross-sectional view explaining a structure of an empty container pressing apparatus according to a fifth embodiment of the present invention.

Next, referring to FIG. 8, a fifth embodiment of the present invention is explained. In the fifth embodiment, the detailed explanation of the same elements explained in the empty container pressing apparatus 1A according to the first embodiment and in the empty container pressing apparatus 1D according to the fourth embodiment is omitted.

As shown in FIG. 8, an empty container pressing apparatus 1E according to the fifth embodiment includes an empty container pressing apparatus 1Ea which provides the pressure applying cylinder section 2 explained above and an empty container pressing apparatus 1Eb which provides a sub cylinder section 7.

In FIG. 8, generally, the suffix "a" is added to the structural elements in the empty container pressing apparatus 1Ea and the suffix "b" is added to the structural elements in the empty container pressing apparatus 1Eb.

Specifically, the empty container pressing apparatus 1E includes the pressure applying cylinder section 2, the first pressing section 3*a* connected to the pressure applying cylinder section 2, the sub cylinder section 7 connected to the pressure applying cylinder section 2 via the transferring means 6 (the transferring section 61), the second pressing section 3*b* connected to the sub cylinder section 7, a first collecting section 5*a* under the first pressing section 3*a*, and a second collecting section 5*b* under the second pressing section 3*b*. With this structure, the pressed empty containers EC can be collected in the first collecting section 5*a* by sliding the bottom plate 3*p* disposed under the first pressing section 3*a*.

The pressure applying cylinder section 2 in the empty container pressing apparatus 1E provides a first cylinder chamber 23*a* and a second cylinder chamber 24*a* separated by a first pressure receiving piston 22*a* which slides in the cylinder chamber 21. Further, the first cylinder chamber 23*a* provides an input port 25 from which the pressure applying medium PM is input in the first cylinder chamber 23*a* from the outside and an output port 26 from which the pressure applying medium PM input in the first cylinder chamber 23*a* is output.

In addition, as explained in the fourth embodiment, the first pressure receiving piston 22*a* in the pressure applying cylinder section 2 can move the first pressing piston 31*a* in the first pressing section 3*a*.

The sub cylinder section 7 includes a first cylinder chamber 23*b* providing an air hole 23*h* for inputting/outputting air, instead of providing the input port 25 and the output port 26 for inputting/outputting the pressure applying medium PM. Therefore, the second pressure receiving piston 22*b* can be pushed upward by transferring pressure generated by the pressure applying cylinder section 2 to the second pressure receiving piston 22*b* in the sub cylinder section 7 via the transferring water TPM. The pressure transferred to the second pressure receiving piston 22*b* is transmitted to the second pressing piston 31*b* in the second pressing section 3*b* via a second pressure transmitting rod, and the empty containers EC (ECb) are pressed (crushed).

As shown in FIG. 8, as the piston returning mechanism 29 in the empty container pressing apparatus 1E, an elastic member 29*d* such as a coil spring having suitable spring force is disposed in the second cylinder chamber 24*a* of the pressure applying cylinder section 2. Since the piston returning mechanism 29 gives the force so that the first pressure receiving piston 22*a* in the pressure applying cylinder section 2 is pushed upward, when the first cylinder chamber 23*a* in the pressure applying cylinder section 2 is connected to the drain pipe D by stopping the input of the pressure applying medium PM with the operation of a three way valve 9*f*, the pressure applying medium PM is output from the first cylinder chamber 23*a*, the first pressure receiving piston 22*a* and the first pressing piston 31*a* can be returned to the positions they respectively occupied before being pushed. Further, the second pressure receiving piston 22*b* and the second pressing piston 31*b* are returned to the positions they respectively occupied before being pushed by the transferring water TPM.

As the transferring means 6 in the empty container pressing apparatus 1E, similar to that in the empty container pressing apparatus 1D according to the fourth embodiment, the second cylinder chamber 24*a* in the pressure applying cylinder section 2 and the second cylinder chamber 24*b* in the sub cylinder section 7 are connected by the transferring section 61, and are filled by transferring water TPM.

However, the transferring means 6 is not limited to the above structure, pressure can be transferred from the pressure applying cylinder section 2 in the empty container pressing apparatus 1Ea to the sub cylinder section 7 in the empty container pressing apparatus 1Eb by the following structure. This is explained as a sixth embodiment.

[Sixth Embodiment]

Figure 9:
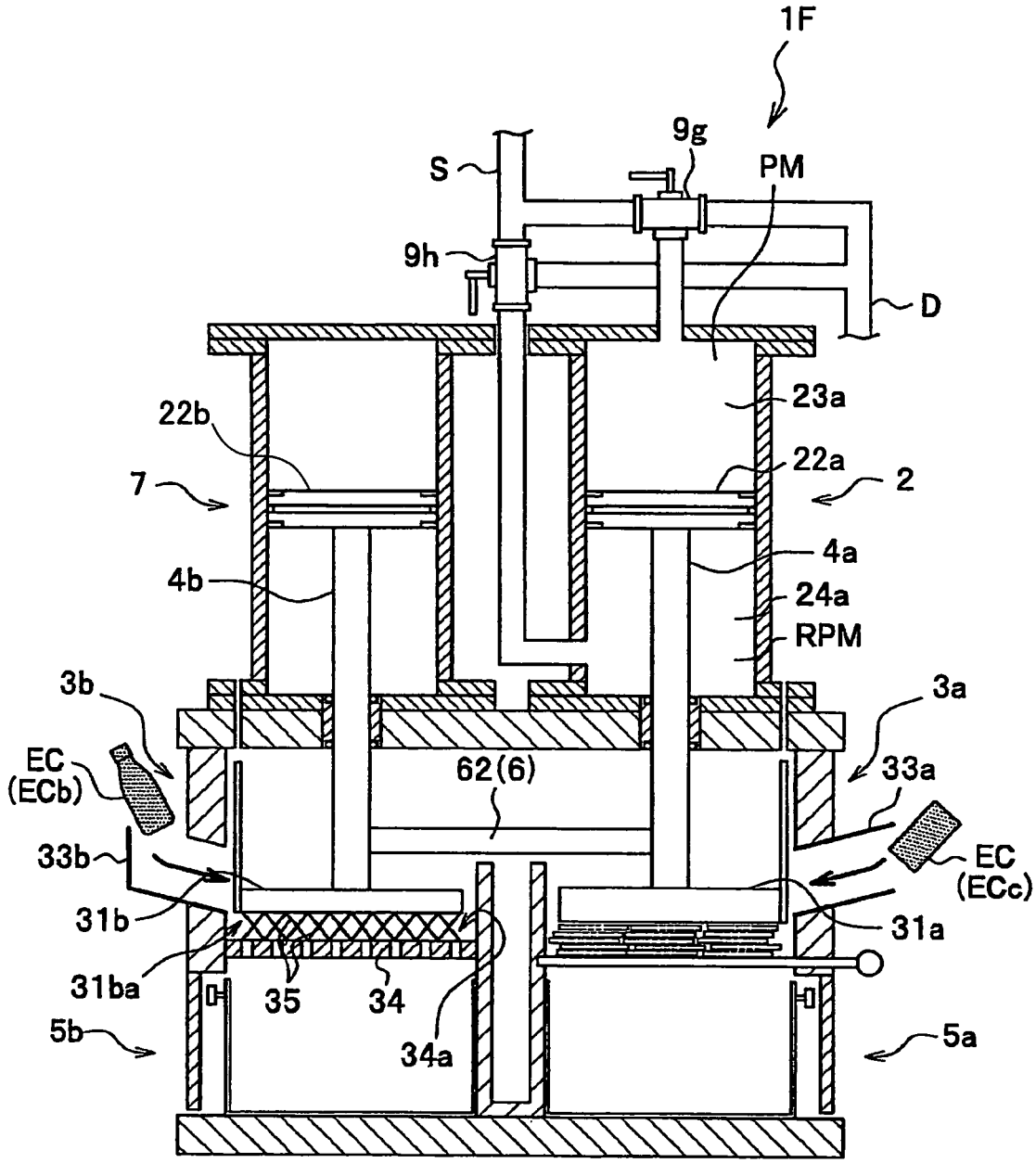
FIG. 9 is a cross-sectional view explaining a structure of an empty container pressing apparatus according to a sixth embodiment of the present invention.

Next, referring to FIG. 9, the sixth embodiment of the present invention is explained. In the sixth embodiment, the detailed explanation of the same elements explained in the empty container pressing apparatus 1A according to the first embodiment and in the empty container pressing apparatus 1E according to the fifth embodiment is omitted.

As shown in FIG. 9, in an empty container pressing apparatus 1F according to the sixth embodiment, a transferring means 6, by as a bar member 62, which fixes the first pressure transmitting rod 4*a* in the pressure applying cylinder section 2 and the second pressure transmitting rod 4*b* in the sub cylinder section 7 in an integrated state, can be used.

In this structure, when the pressure applying medium PM is input to the first cylinder chamber 23*a* from the outside by operating three way valves 9*g* and 9*h* and the first pressure receiving piston 22*a* in the pressure applying cylinder section 2 is pushed by the pressure, the first pressing piston 31*a* in the first pressing section 3*a* and the second pressing piston 31*b* in the second pressing section 3*b* can be moved at the same time. Further, when the return pressure applying medium RPM is input to the second cylinder chamber 24*a* by operating the three way valves 9*g* and 9*h*, the first pressure receiving piston 22*a* and the second pressure receiving piston 22*b* can be returned to the positions they respectively occupied before being pushed.

In the empty container pressing apparatus 1F according to the sixth embodiment, since the second pressure receiving piston 22*b* does not directly receive the pressure, it is possible not to provide the second pressure receiving piston 22*b*. However, it is preferable to provide the second pressure receiving piston 22*b* so as to function as a deflection preventing guide at the time when the second pressure transmitting rod 4*b* and the second pressing piston 31*b* are slid.

[Seventh Embodiment]

Figure 10:
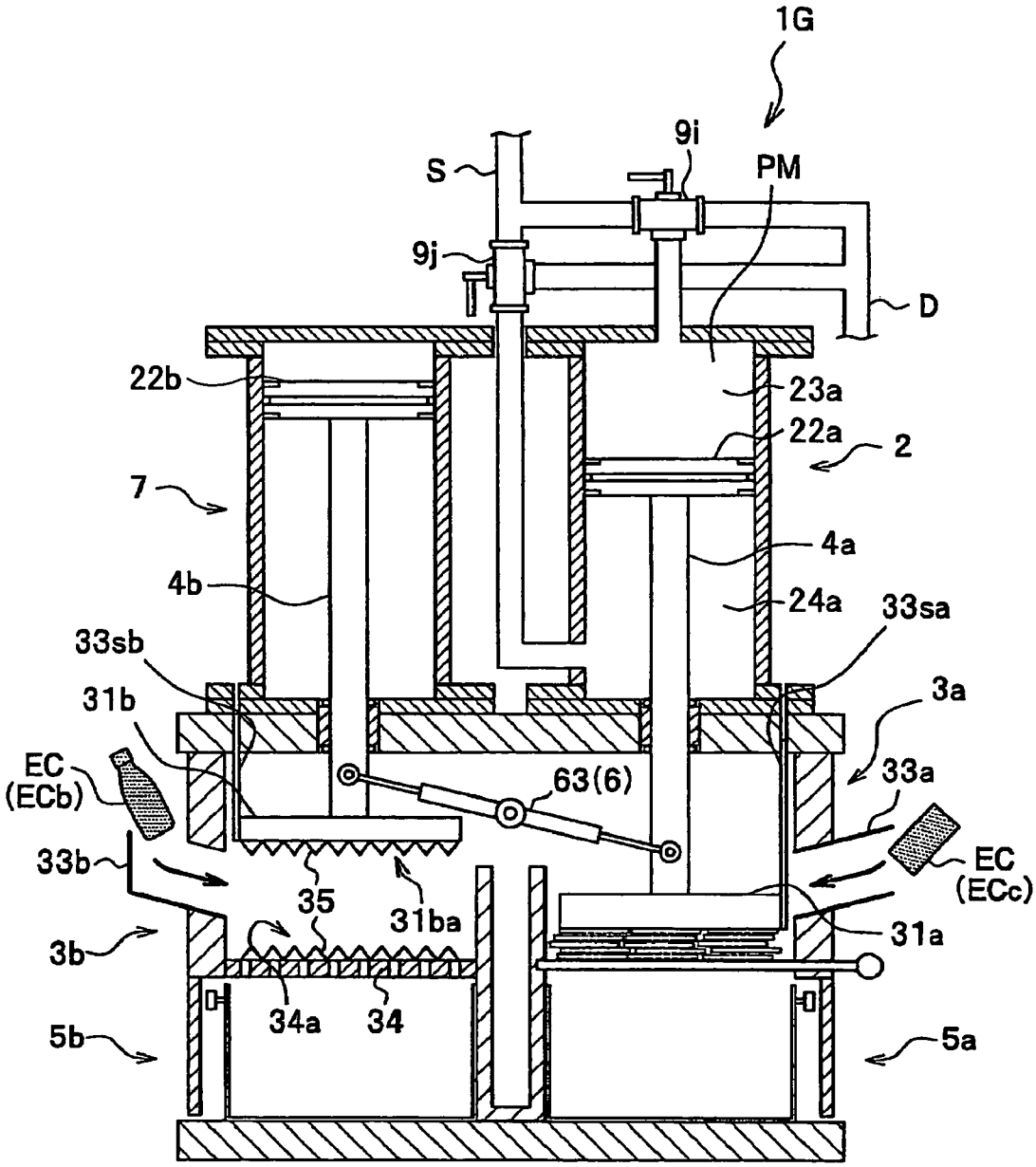
FIG. 10 is a cross-sectional view explaining a structure of an empty container pressing apparatus according to a seventh embodiment of the present invention.

Next, referring to FIG. 10, a seventh embodiment of the present invention is explained. In the seventh embodiment, the detailed explanation of the same elements explained in the empty container pressing apparatus 1A according to the first embodiment and in the empty container pressing apparatus 1E according to the fifth embodiment is omitted.

As shown in FIG. 10, in an empty container pressing apparatus 1G according to the seventh embodiment, a transferring means 6, which connects the first pressure transmitting rod 4*a* in the pressure applying cylinder section 2 to the second pressure transmitting rod 4*b* in the sub cylinder section 7 as a retractable bar member 63 that is supported in its center by an axle in a manner so that connecting positions of the retractable bar member 63 with the first and second pressure transmitting rods 4*a* and 4*b* can move up and down so that the center position of the retractable bar member 63 is the center, can be used.

In this structure, for example, when the pressure applying medium PM is input to the first cylinder chamber 23*a* of the pressure applying cylinder section 2 from the outside by operating three way valves 9*i* and 9*j* and the first pressure receiving piston 22*a* is pushed by the pressure, the first pressure transmitting rod 4*a* and the first pressing piston 31*a* are slid downward. At this time, since the retractable bar member 63 is connected to the first pressure transmitting rod 4*a* and the second pressure transmitting rod 4*b* one at each end in a rotating state and the center of the retractable bar member 63 is rotationally supported, the second pressure transmitting rod 4*b* and the second pressing piston 31*b* are pushed upward so that the center position of the retractable bar member 63 is the center.

That is, when the retractable bar member 63, to which the first pressure transmitting rod 4*a* and the second pressure transmitting rod 4*b* are connected at respectively, is moved like a seesaw, the first pressing piston 31*a* in the first pressing section 3*a* and the second pressing piston 31*b* in the second pressing section 3*b* can be moved together. When the pressure applying medium PM is input to the second cylinder chamber 24*a* by operating the three way valves 9*j* and 9*i*, the first pressure receiving piston 22*a* can be pushed upward.

In the structure according to the seventh embodiment, since the empty cans ECc and the empty bottles ECb can be pressed (crushed) by one operation, the operation can be executed efficiently and it is possible that the amount of the pressure applying medium PM can be reduced.

Further, in the empty container pressing apparatus 1G according to the seventh embodiment, similar to the empty container pressing apparatus 1F according to the sixth embodiment, since the second pressure receiving piston 22*b* does not directly receive the pressure, it is possible not to provide the second pressure receiving piston 22*b*. However, it is preferable to provide the second pressure receiving piston 22*b* so as to function as a deflection preventing guide at the time when the second pressure transmitting rod 4*b* and the second pressing piston 31*b* are slid.

Figure 11:
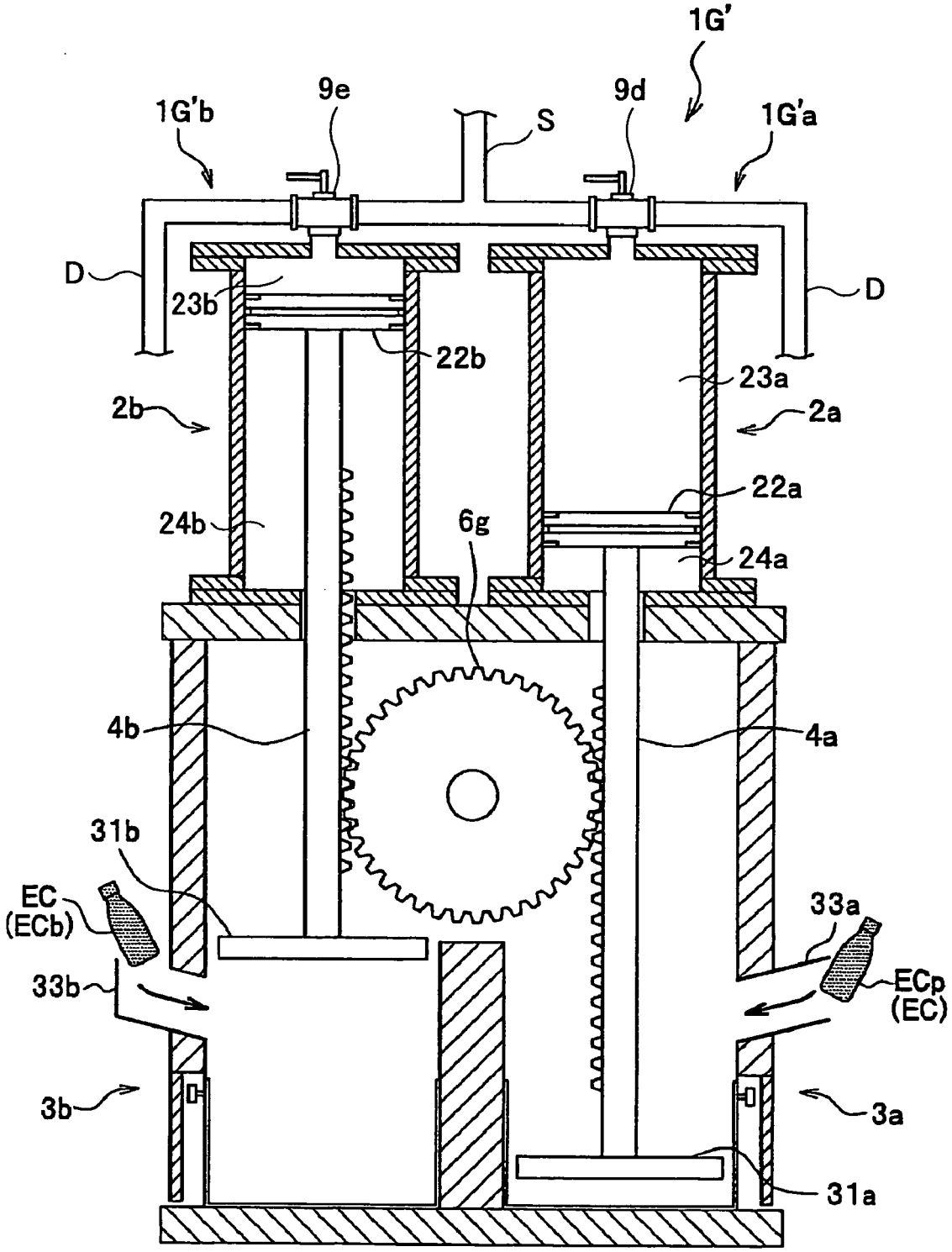
FIG. 11 is a cross-sectional view explaining a structure of a modified example of the empty container pressing apparatus according to the seventh embodiment of the present invention.

In the empty container pressing apparatus 1G according to the seventh embodiment, the pistons are moved like a seesaw by using the retractable bar member 63. However, as shown in FIG. 11, an empty container pressing apparatus 1G' can be used. That is, in the empty container pressing apparatus 1G', empty container pressing apparatuses 1G'a and 1G'b are connected. In the empty container pressing apparatus 1G', racks are formed on the first and second pressure transmitting rods 4*a* and 4*b* and the racks are meshed with a pinion 6*g* so that the first and second pressure transmitting rods 4*a* and 4*b* are moved simultaneously. This structure is referred to as a gear seesaw. With this structure, when the first pressing piston 31*a* (the second pressing piston 31*b*) is pushed downward, the second pressing piston 31*b* (the first pressing piston 31*a*) is pushed upward, by the work of the first and second pressure transmitting rods 4*a* and 4*b* and the pinion 6*g*.

In FIG. 11, generally, the suffix "a" is added to the structural elements in the empty container pressing apparatus 1G'a and the suffix "b" is added to the structural elements in the empty container pressing apparatus 1G'b.

The empty container pressing apparatuses 1D through 1G shown in FIGS. 7 through 10 schematically show structures in which empty cans ECc (empty PET bottles ECp) can be pressed in the first pressing section 3*a* and empty bottles ECb can be pressed (crushed) in the second pressing section 3*b*.

As shown in FIGS. 7, 9, and 10, when the empty bottles ECb are pressed (crushed) in the second pressing section 3*b*, as explained above, the second pressing piston 31*b* is moved downward (in FIG. 8, upward) and the empty bottles ECb are pressed (crushed) between the lower face 31*ba* of the second pressing piston 31*b* (in FIG. 8, the upper face 31*bb* of the second pressing piston 31*b*) and the upper face 34*a* of the empty bottle putting plate 34 of the second pressing section 3*b* (in FIG. 8, the ceiling face 3*bc* of the second pressing section 3*b*). At this time, in order to easily press (crush) the empty bottles ECb, it is preferable that plural crests 35 having approximately 1 to 5 cm height be formed on at least one of the upper face 34*a* of the empty bottle putting plate 34 in the second pressing section 3*b* (in FIG. 8, the ceiling face 3*bc* of the second pressing section 3*b*) and the lower face 31*ba* (in FIG. 8, the upper face 31*bb*) of the second pressing piston 31*b*. (In the second pressing section 3*b* in FIG. 8, the crests 35 are formed only on the ceiling face 3*bc*.) Further, in order to easily drop the fragments of the crushed empty bottles ECb in the second collecting section 5*b*, similar to that in the empty container pressing apparatus 1A', it is preferable that the empty bottle putting plate 34 (in FIG. 8, the second pressing piston 31*b*) have through holes having an arbitrary shape with some intervals.

[Eighth Embodiment]

Figure 12:
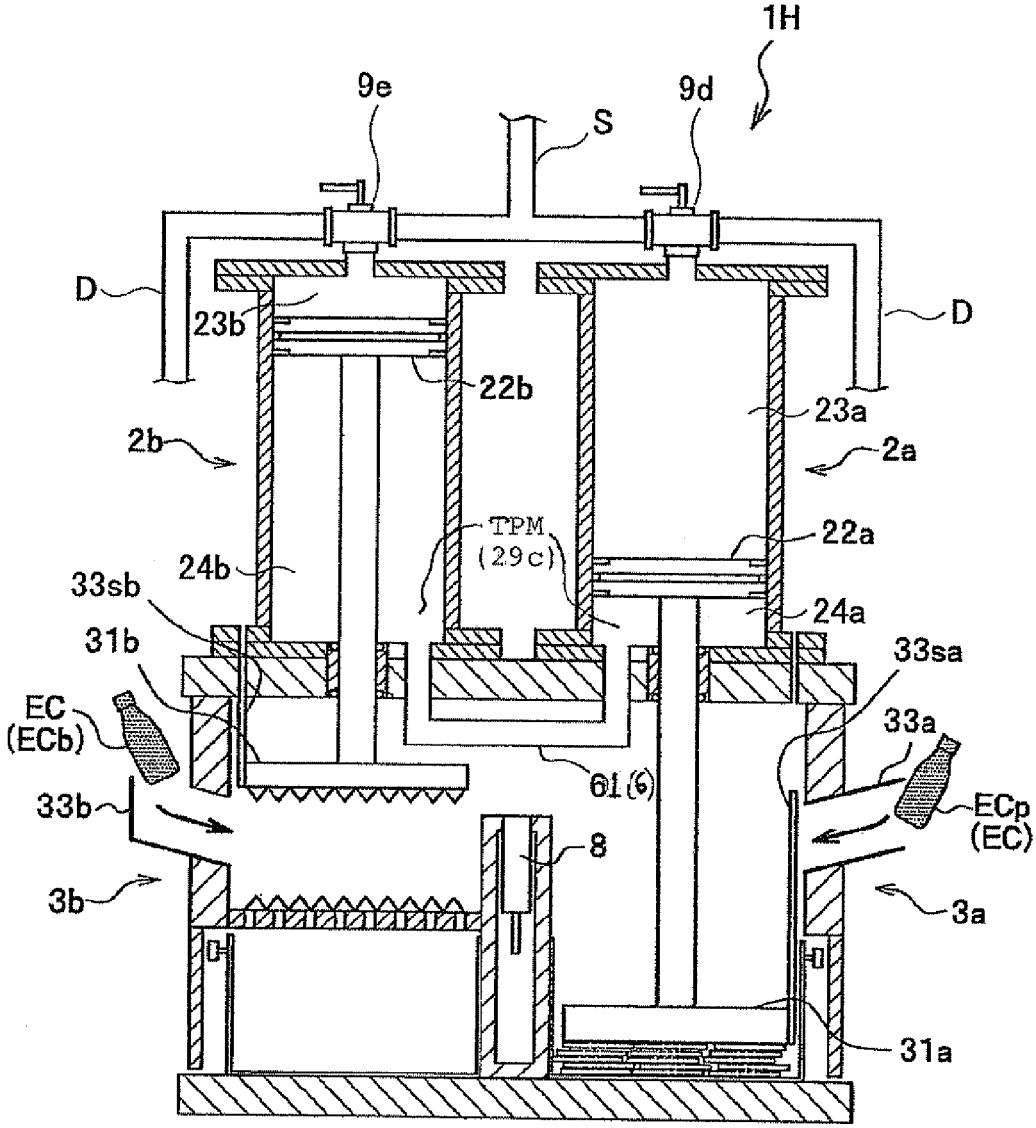
FIG. 12 is a cross-sectional view explaining a structure of an empty container pressing apparatus according to an eighth embodiment of the present invention.
Figure 13:
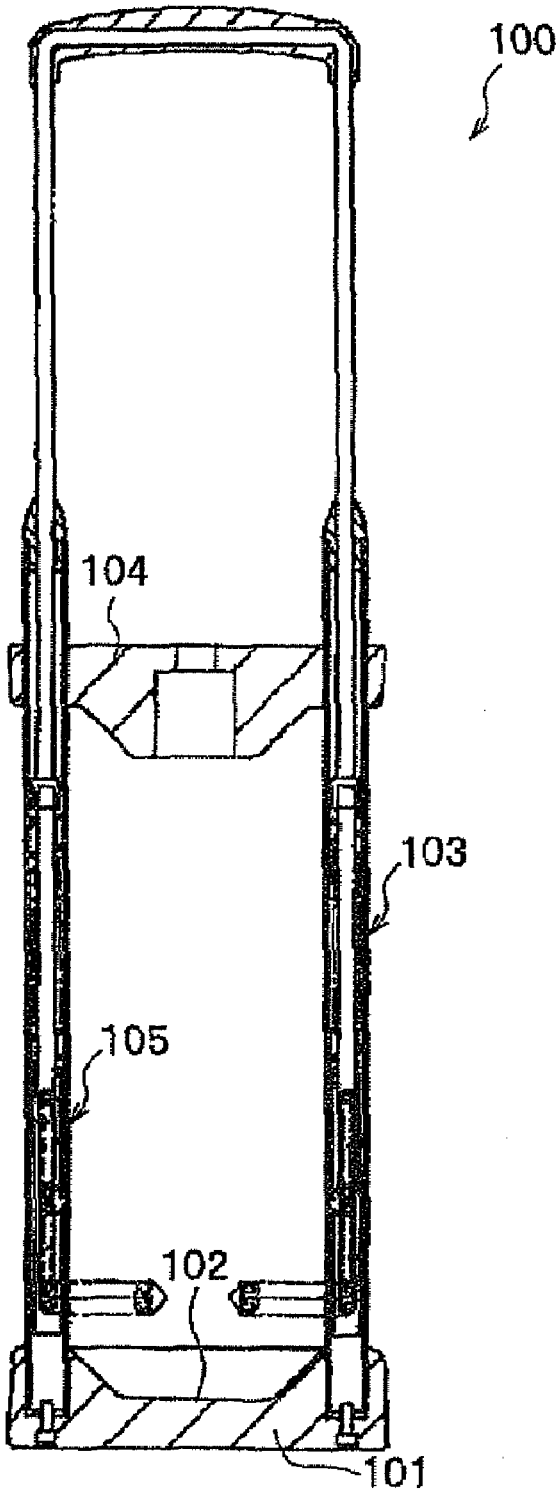
FIG.13 PRIOR ART
FIG. 13 is a diagram showing a conventional empty container pressing apparatus.
Figure 14:
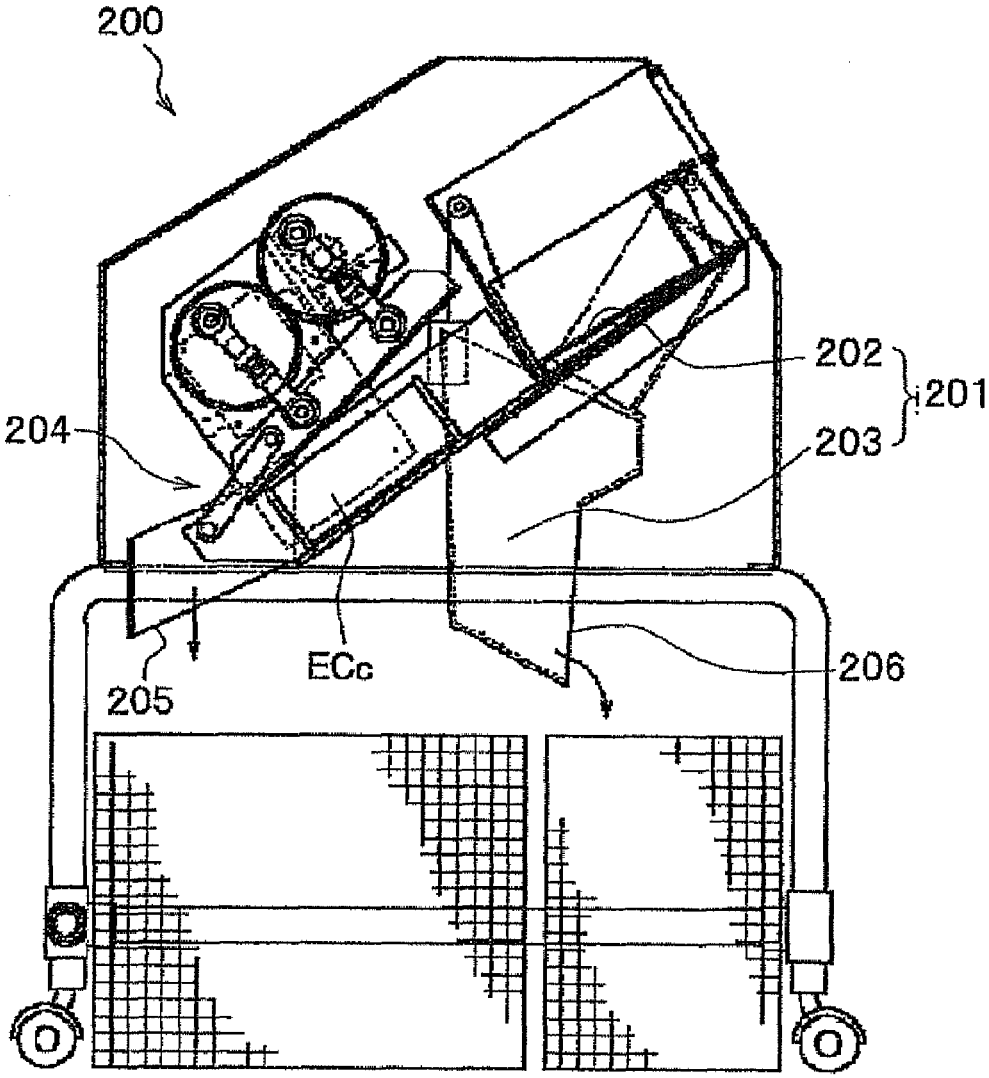
FIG.14 PRIOR ART
FIG. 14 is a diagram showing another conventional empty container pressing apparatus.
Figure 15:
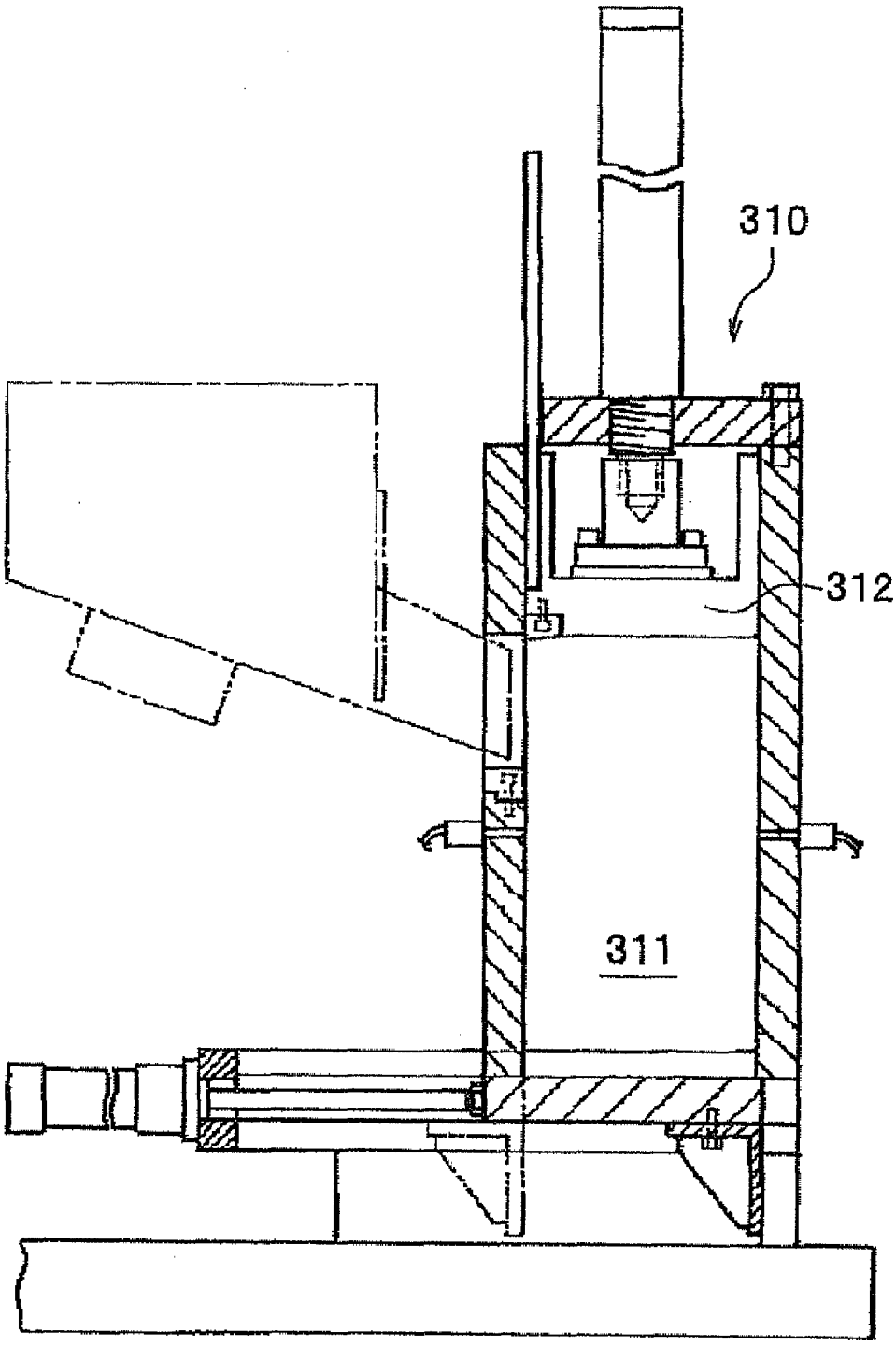
FIG.15 PRIOR ART
FIG. 15 is a diagram showing the other conventional empty container pressing apparatus.

Next, referring to FIG. 12, an empty container pressing apparatus 1H according to an eighth embodiment of the present invention is explained. In the eighth embodiment, the detailed explanation of the same elements explained in the empty container pressing apparatus 1A according to the first embodiment through in the empty container pressing apparatus 1G according to the seventh embodiment is omitted.

As shown in FIG. 12, the empty container pressing apparatus 1H has nearly the same structure of the empty container pressing apparatus 1D according to the fourth embodiment shown in FIG. 7. However, the empty container pressing apparatus 1H provides a heating device 8 to heat the first pressing section 3*a* so that empty PET bottles ECp are easily pressed. The empty PET bottle ECp has strong flexibility caused by its material properties; after being pressed at room temperature, the original shape is resumed to some degree even when its cap is removed. Therefore it is difficult to densely compress the empty PET bottles ECp. In order to densely compress the empty PET bottles ECp, the first pressing section 3*a* is heated to 85 to 120° C. by the heating device 8, and with this, the resilience of the empty PET bottles ECp is lost by being softened with the heat. When the empty PET bottles ECp are cooled after being pressed with the heat, the original shape is not restored. Therefore, the empty PET bottles ECp can be easily pressed with the heat. In FIG. 12, the collecting section 5*a* shown in FIG. 7 is not shown. However, the empty container pressing apparatus 1H can provide the collecting section 5*a*.

As the heating device 8, a steam heating device which supplies steam of the above temperature to the first pressing section 3*a* can be used; further, an electric heater using a heating wire and a gas heater using gas can be used.

In the empty container pressing apparatuses 1A through 1C, while the pressing piston 31 is pressing the empty containers EC, it is preferable to provide a shutter so that new empty containers EC are not input to the pressing section 3. Further, in the empty container pressing apparatuses 1D through 1H, when the first and the second pressing pistons 31*a* and 31*b* are pressing the empty containers EC, it is preferable to provide shutters so that new empty containers EC are not input to the first and the second pressing sections 3*a* and 3*b*. Specifically, in case of the empty container pressing apparatuses 1D through 1H, a first shutter 33*sa* is fixed to the first pressing piston 31*a* so that the first input section 33*a* is closed while the first pressing piston 31*a* is sliding downward and a second shutter 33*sb* is fixed to the second pressing piston 31*b* so that the second input section 33*b* is closed while the second pressing piston 31*b* is sliding. This structure is preferable.

The empty container pressing apparatus of the present invention is explained in detain in the first through the eighth embodiments. However, the present invention is not limited to the embodiments, but variations and modifications may be made without departing from the scope of the present invention.

The pressing piston, the first pressing piston, and the second pressing piston explained in the first through eighth embodiments are pressing (crushing) members to press (crush) empty containers, such as empty cans, empty PET bottle, and empty bottles.

In the present invention, it is preferable to provide a separating mechanism that can separate empty containers into empty cans, empty bottles, empty PET bottles, and so on in the input section. When the separating mechanism is provided in the input section, the empty containers can be automatically pressed (crushed) in a separated state by only inputting the empty containers in the input section. In a case where empty bottles are separated from the empty containers, for example, an opening and closing window which drops only the empty bottles by only being operated when the weight of the empty bottle is disposed in the input section, and with this, only the empty bottles are selected by the opening and closing window and are sent to the pressing (crushing) section for the empty bottles. In a case where empty cans and empty PET bottles are separated, for example, an air nozzle whose air pressure can blow off only the empty PET bottles is disposed, and the empty PET bottles are sent to the pressing section for the empty PET bottles. The remaining empty cans are sent to the pressing section for the empty cans. Further, the remained empty cans can be sent to the pressing section for the empty cans; however, steel cans can be separated from aluminum cans by using a magnetic member such as a magnet. With this, the steel cans and the aluminum cans can be pressed separately.

As mentioned above, according to the structure of the empty container pressing apparatus of the present invention, the empty containers can be easily pressed (crushed) efficiently with a relatively simple structure and at a low cost without providing a specific power generating apparatus.

In addition, in the empty container pressing apparatus 1E of the fifth embodiment shown in FIG. 8, the second cylinder chamber 24*a* of the pressure applying cylinder section 2 and the second cylinder chamber 24*b* of the sub cylinder section 5 are connected with the transferring means 6 (transferring section 61). However, the second cylinder chamber 24*a* of the pressure applying cylinder section 2 and the first cylinder chamber 23*b* of the sub cylinder section 5 can be connected with the transferring section 61 (not shown) and the transferring section 61 is filled with the transferring water TMP. In this case, when the first pressure receiving piston 22*a* of the pressure applying cylinder section 2 is pushed downward by the pressure of the pressure applying medium PM, the transferring water TMP in the second cylinder chamber 24*a* of the pressure applying cylinder section 2 is sent to the first cylinder chamber 23*b* of the sub cylinder section 7, the second pressure receiving piston 22*b* of the sub cylinder section 7 is pushed downward. Therefore, the first pressing piston 31*a* and the second pressing piston 31*b* can press the empty containers at the same time.

Further, in the empty container pressing apparatus 1E of the fifth embodiment shown in FIG. 8, in order to return the first pressure receiving piston 22*a* to the original position, as the piston returning mechanism 29, the elastic member 29*d* such as a coil spring is disposed under the first pressure receiving piston 22*a*, that is, in the second cylinder chamber 24*a* of the pressure applying cylinder section 2. However, the elastic member 29*d* can be disposed on the second pressure receiving piston 22*b* of the sub cylinder section 7, that is, in the first cylinder chamber 23*b* of the sub cylinder section 7. With this, the second pressure receiving piston 22*b* can be pushed downward. Further, the piston returning mechanism 29 can be disposed both under the first pressure receiving piston 22*a* and on the second pressure receiving piston 23*b*.

In addition, in the empty container pressing apparatus 1H according to the eighth embodiment shown in FIG. 12, the empty PET bottles are densely compressed by using the heating device 8. However, the empty PET bottles can be shredded by using a pressing piston having a lattice-shaped blade whose one side is, for example, 1 to 5 cm (not shown).

Furthermore, depending on the necessity, a waste liquid draining system which collects liquid remaining in the empty containers and drains it can be disposed at the bottom of the pressing section and the collecting section.

With this structure, the empty container pressing apparatus of the present invention can be used as an apparatus that densely compresses waste such as vegetable garbage. Since approximately 95% of vegetable garbage is water (liquid), the water containing in the vegetable garbage can be removed and drained by using the empty container pressing apparatus. Consequently, the volume of the vegetable garbage can be reduced. When the water in the vegetable garbage is removed, the burning efficiency of the vegetable garbage can be increased. Further, water evaporating at the time of burning can be reduced and the damage to an incinerator can be reduced. As mentioned above, the empty container pressing apparatus of the present invention can contribute to the preservation of the natural environment in many ways.

The present invention is based on Japanese Priority Patent Application No. 2004-352083, filed on Dec. 3, 2004, with the Japanese Patent Office, the entire contents of which are hereby incorporated by reference.

What is claimed is:

1. An empty container pressing system, comprising two vertically oriented empty container pressing apparatuses connected to one another with each of the two empty container pressing apparatus comprising:

a pressure applying cylinder section in which a first cylinder chamber and a second cylinder chamber separated by a pressure receiving piston which slides in a cylinder chamber having the first cylinder chamber and the second cylinder chamber are disposed, wherein a changing over valve that works as an inlet to which a pressure applying medium supplied from an outside is input into the first cylinder chamber and also works as an outlet which drains the input pressure applying medium, the changing over valve is connected to the first cylinder chamber;

a pressing section which is connected to the pressure applying cylinder section, and provides a pressing piston that moves together with the pressure receiving piston via a pressure transmitting member and applies pressing force to a plurality of empty containers;

a collecting section connecting to the pressing section for collecting a pressed empty container; and a piston returning member that returns the pressure receiving piston to a position the pressure receiving piston occupied before being moved; wherein pressure received at the pressure receiving piston of one of the empty container pressing apparatuses is transmitted to the pressure receiving piston or the pressure transmitting member of the other of the empty container pressing apparatuses via a transferring section composed of a transferring member including one of a liquid and a mechanical linking member, and the pressure receiving piston and the pressing piston of one of the empty container pressing apparatuses and the pressure receiving piston and the pressing piston of the other of the empty container pressing apparatuses are moved together at the same time by the pressure received at the pressure receiving piston of one of the empty container pressing apparatuses.

2. The empty container pressing system as claimed in claim 1, wherein:

the transferring section connects the second cylinder chambers of one of the pressure applying cylinder sections and the other of the pressure applying cylinder sections and one of water and oil is supplied to fill in the second cylinder chambers and the transferring section.

3. The empty container pressing system as claimed in claim 1, wherein:

the empty container is at least one of an empty can, an empty bottle, and an empty PET bottle.

4. The empty container pressing system as claimed in claim 1, wherein:

the pressure applying medium is water.

5. The empty container pressing system as claimed in claim 1, wherein:

the pressure of the pressure applying medium is 0.2 to 1 MPa.

6. The empty container pressing system as claimed in claim 1, wherein:

a bottom plate of at least one of the pressing sections is movably connected to the collecting section.

7. The empty container pressing system as claimed in claim 1, further comprising:

a heating member that heats at least one of the pressing sections.

* * * * *